US006719401B2

(12) United States Patent
Takahashi

(10) Patent No.: US 6,719,401 B2
(45) Date of Patent: Apr. 13, 2004

(54) INK EJECTABILITY MAINTENANCE DEVICE AND INK JET PRINTER INCORPORATING THE SAME

(75) Inventor: Nobuhito Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/122,404

(22) Filed: Apr. 16, 2002

(65) Prior Publication Data

US 2002/0163552 A1 Nov. 7, 2002

(30) Foreign Application Priority Data

Apr. 17, 2001 (JP) ..... P2001-118744

(51) Int. Cl.[7] ..... B41J 2/165
(52) U.S. Cl. ..... 347/33

(58) Field of Search ..... 347/29, 30, 32, 347/33; 15/250, 361, 252.5; 101/155

(56) References Cited

FOREIGN PATENT DOCUMENTS

| | | | | |
|---|---|---|---|---|
| JP | 404278358 A | * | 10/1992 | ..... 347/33 |
| JP | 11-138830 | | 5/1999 | |

* cited by examiner

*Primary Examiner*—Shih-Wen Hsieh
(74) *Attorney, Agent, or Firm*—Sughrue Mion, PLLC

(57) ABSTRACT

In order to maintain an ink ejectability of a print head which ejects ink droplets to a recording medium, a wiper wipes a nozzle formation face of the print head. A wiper cleaner is formed with a slit which scrape away adhesions on the wiper when the wiper passes through the slit. A width of the slit is substantially identical with a thickness of the wiper.

9 Claims, 32 Drawing Sheets

INK EJECTABILITY MAINTENANCE DEVICE AND INK JET PRINTER INCORPORATING THE SAME

BACKGROUND OF THE INVENTION

The present invention relates to an ink ejectability maintenance device for maintaining constant ink ejectability of a recording head for ejecting ink droplets toward a recording medium, as well as to an ink jet printer equipped with the ink ejectability maintenance device.

An ink jet printer is usually equipped with a print head mounted on a carriage which travels back and forth in a main scanning direction, and a medium feeder for intermittently feeding a recording medium, such as print paper, in a sub-scanning direction in preset increments. The print head is actuated in the main scanning direction while the recording medium is being fed in the sub-scanning direction, and ink droplets are ejected toward the recording medium from the print head.

A mono-color ink jet printer is usually equipped with one print head. In contrast, a full-color ink jet printer is equipped with a black-ink print head for ejecting black ink, and a plurality of color-ink print heads for ejecting various colors of ink, such as yellow, cyan, and magenta.

A print head of an ink jet printer of such a construction has a pressure generation chamber and a nozzle orifice communicated therewith. Ink is stored in a pressure generation chamber and pressurized at a predetermined pressure, whereby ink droplets of controlled size are ejected from the nozzle orifice to the recording medium. Accordingly, when variations arise in the ink ejectability of the nozzle orifice of the print head, the quality of a recorded image is greatly affected. Hence, the ink ejectability must be maintained constant at all times.

The ink ejectability is changed by various phenomena, such as an increase in viscosity or solidification due to evaporation or drying of solvent in ink by way of the nozzle orifice, clogging due to solid material, adhesion of dust to the nozzles, and intrusion of air bubbles into ink. In order to prevent occurrence of such a change in characteristic, the ink jet printer is equipped with an ink ejectability maintenance device which eliminates the above-described phenomena causing variations to maintain the ink ejectability constant.

The ink ejectability maintenance device is equipped with a capping device, a suction pump, and a wiping device. The capping device is arranged so as to seal a nozzle formation face of a print head when no recording operation is performed, thereby isolating the nozzle orifice from the outside. Thus, the ink ejectability maintenance device has the function of inhibiting evaporation and drying of ink, thereby hindering an increase in viscosity and solidification of ink. Even when the nozzle formation face is sealed with the capping device, there cannot be completely prevented occurrence of clogging due to solid material in the nozzle orifice or intrusion of air bubbles into an ink flow channel. The ink jet printer is further equipped with a suction pump for the purpose of completely preventing occurrence of these problems.

The suction pump is configured so as to exert negative pressure on the nozzle orifice while the nozzle formation face is sealed with the capping device. The suction pump has the function of forcefully causing ink to be discharged from the nozzle orifice through suction, thereby eliminating solid material or air bubbles. Forceful discharge of ink to be performed by the suction pump is usually carried out when a recording operation is resumed after the ink jet printer has remained inoperative for a long time period or when the user has actuated a specifically-designed switch provided in a control panel with the understanding that deterioration of recorded image quality.

When ink is forcefully discharged by the suction pump, ink may splash across a nozzle formation face of the printer head, and in each nozzle orifice an ink meniscus may be disturbed. The nozzle formation face of the print head becomes susceptible to adhesion of extraneous matter with lapse of time. Hence, the print head is equipped with a wiping device for wiping the nozzle formation face, as required.

The wiping device has a wiping member whose base end is caught by a holder, and is constituted of an elastic plate such as rubber. An edge of the extremity of the wiping member is elastically pressed against a nozzle formation face, thereby effecting relative reciprocal movement so as to wipe the nozzle formation face. As a result, ink or extraneous matter adhering to the nozzle formation face is wiped, and ink meniscuses of respective nozzle orifices are made uniform. In short, the wiping device has the function of making the nozzle formation face stable.

Since the cleaning property of the wiping member can be maintained constant by removing ink or extraneous matter adhering to the surface of the wiping member, the wiping device also has a cleaning member. As a cleaning method to be performed by the cleaning member, there has been adopted a general method in which a scraper is placed as a cleaning member in a position perpendicular to the moving direction of the wiping member. The wiping member is caused to come into collision with the scraper, thereby elastically deforming the wiping member. The wiping member is caused to pass through the scraper, thereby removing the ink adhering to the surface of the wiping member.

According to the cleaning method to be performed by such an ink ejectability maintenance device, when the wiping member comes into collision with the scraper, a collision sound arises. Acting as noise, the sound may adversely affect electronic components and induce faulty operation. Moreover, when the wiping member departs from the scraper, the wiping member is restored to its original shape, which may induce splashing of ink and deteriorate recording accuracy.

SUMMARY OF THE INVENTION

It is therefore an object of the present invention to provide an ink ejectability maintenance device capable of preventing occurrence of noise or splashing of ink, which would otherwise be caused when a wiping member is cleaned, as well as an ink jet printer equipped with the ink ejectability maintenance device.

In order to achieve the above object, according to the present invention, there is provided an ink ejectability maintenance device for maintaining an ink ejectability of a print head which ejects ink droplets to a recording medium, comprising:

- a wiper, which wipes a nozzle formation face of the print head; and
- a wiper cleaner formed with a slit, which removes adhesions on the wiper when the wiper passes through the slit.

Accordingly, the wiper cleaner can scrape away the ink or the like adhering to the wiper without involvement of collision with the wiper. Hence, there does not arise a faulty operation, which would otherwise be caused by noise such as collision sound. Further, the wiper is not subjected to elastic deformation or restoration. Hence, there does not arise deterioration in recording accuracy, which would otherwise be caused by splashing of ink.

Preferably, a width of the slit is substantially identical with a thickness of the wiper. Accordingly, both side surfaces of the wiper where adherents particularly remain when the print head is wiped away can be cleaned.

Preferably, the wiper and the wiper cleaner change their position in cooperation with each other.

Accordingly, adherents adhering to the area where an interference arises between the wiper and the print head can be wiped away completely. The load imposed on the wiper when the wiper passes through the slit of the wiper cleaner can be reduced by minimizing a wiping range.

Here, it is preferable that the wiper is movable between a wiping position and a non-wiping position, and passes through the slit while moving from one of the wiping position and the non-wiping position to the other.

Accordingly, the wiper can be cleaned at all times after the wiper has wiped away the print head.

Further, it is preferable that the wiper cleaner is pivotably held on the device.

Accordingly, the wiper cleaner can readily effect cooperative movement relative to the wiper. Thus, adherents adhering to the wiper can be wiped away completely.

Still further, it is preferable that the wiper cleaner is provided with a guide pin which is fitted with a guide groove formed on a wiper holder which holds the wiper.

Accordingly, the wiper cleaner can follow movement of the wiper at all times, thereby completely wiping away adherents adhering to the wiper.

In order to attain the above advantages, according to the present invention, there is also provided an ink jet printer comprising the above ink ejectability maintenance device.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An embodiment of the invention will be described in detail hereinbelow by reference to the accompanying drawings.

Figure 1:
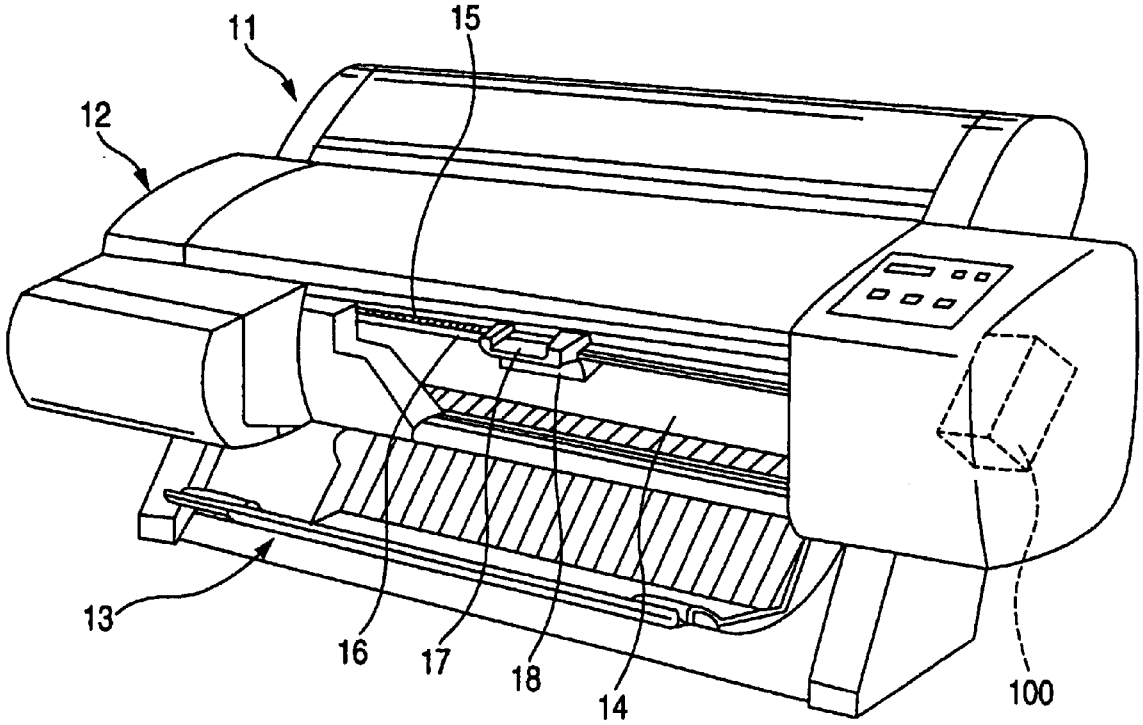
FIG. 1 is a perspective view showing the whole configuration of an ink jet printer according to one embodiment of the invention.

An ink jet printer shown in FIG. 1 is a large printer capable of printing data onto print paper of relatively large size; e.g., paper of 594 mm (JIS A1-size paper) or paper of 728 mm (JIS B1-size paper).

In the ink jet printer, a paper feed section 11, a recording section 12, and a paper discharge section 13 are aligned so as to be parallel and to assume a diagonal relationship; specifically, the lower paper discharge section 13 is located closer to the operator than is the upper paper feed section 11. Print paper is discharged outside after having been subjected to predetermined printing during the course of being supplied from the paper feed section 11 to the paper discharge section 13 by way of the recording section 12. A paper transporting path 14 constituted at the time of printing is formed at an inclination of, e.g., 65 degrees, with respect to a horizontal plane. A nozzle formation face of a print head 18 mounted on a carriage 17, which travels back and forth in the main scanning direction along a guide shaft 16 by a driving belt 15, is provided at an angle of, e.g., 65 degrees, so as to become parallel with the paper transporting path 14.

An ink ejectability maintenance device 100 for maintaining the ink ejectability of the print head 18 constant is disposed in a position which serves as the home position of the carriage 17. While the carriage 17 is situated at the home position, the ink ejectability maintenance device 100 performs an operation for maintaining the ink ejectability of the print head 18.

Figure 2:
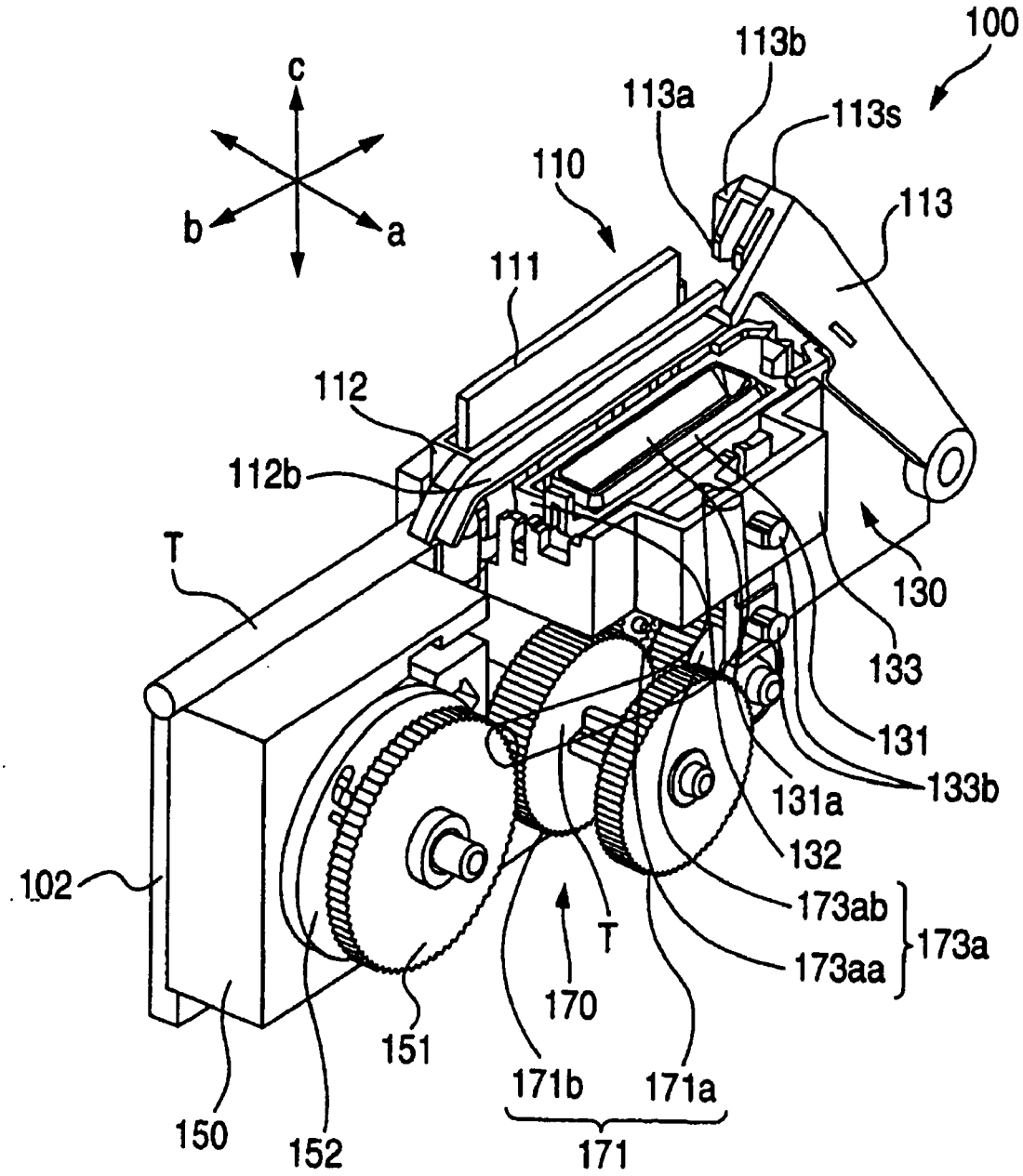
FIG. 2 is a perspective view showing an ink ejectability maintenance device assembled into the ink jet printer.
Figure 3:
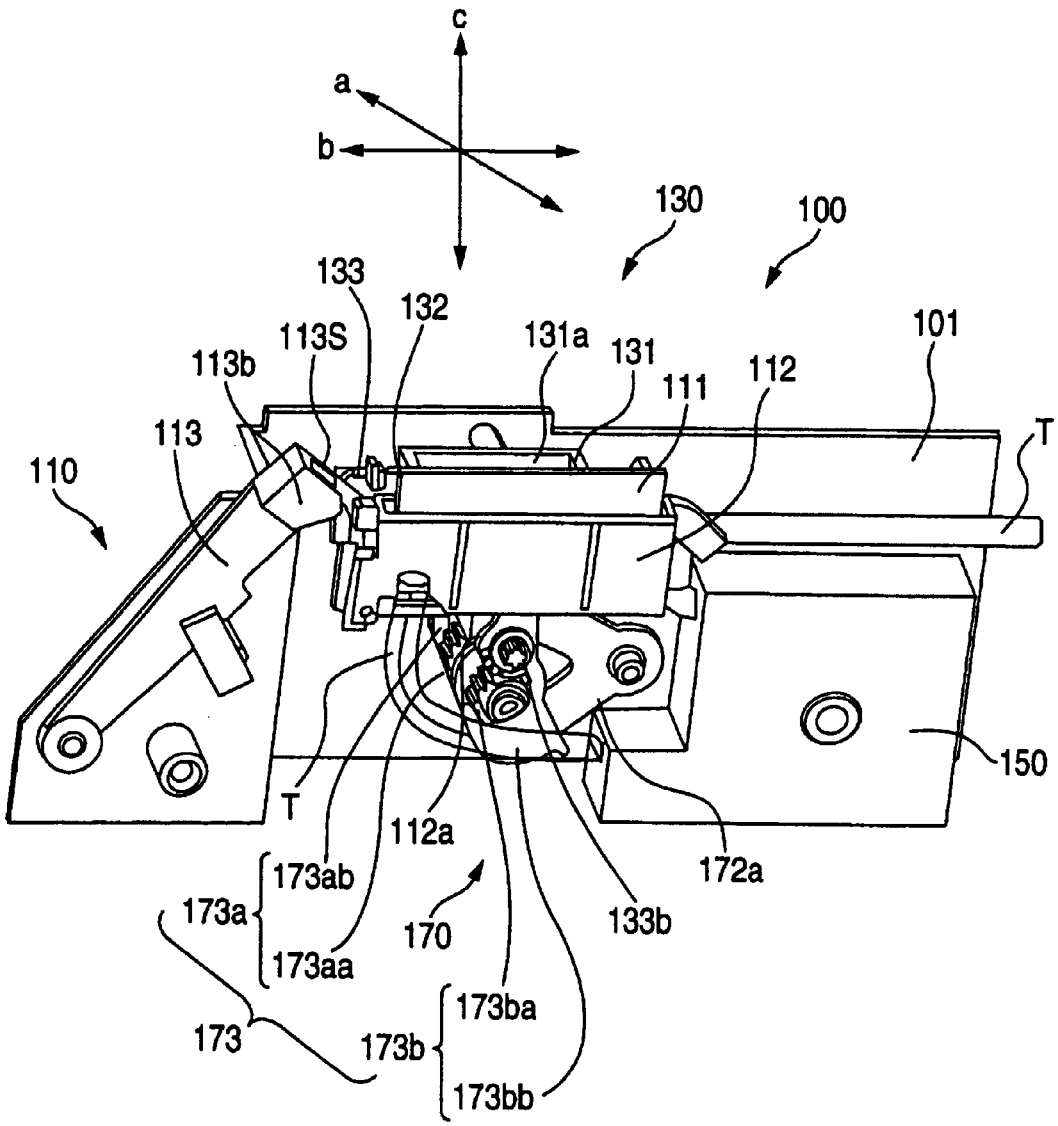
FIG. 3 is a perspective view of the ink ejectability maintenance device shown in FIG. 2 when viewed from the back.
Figure 4:
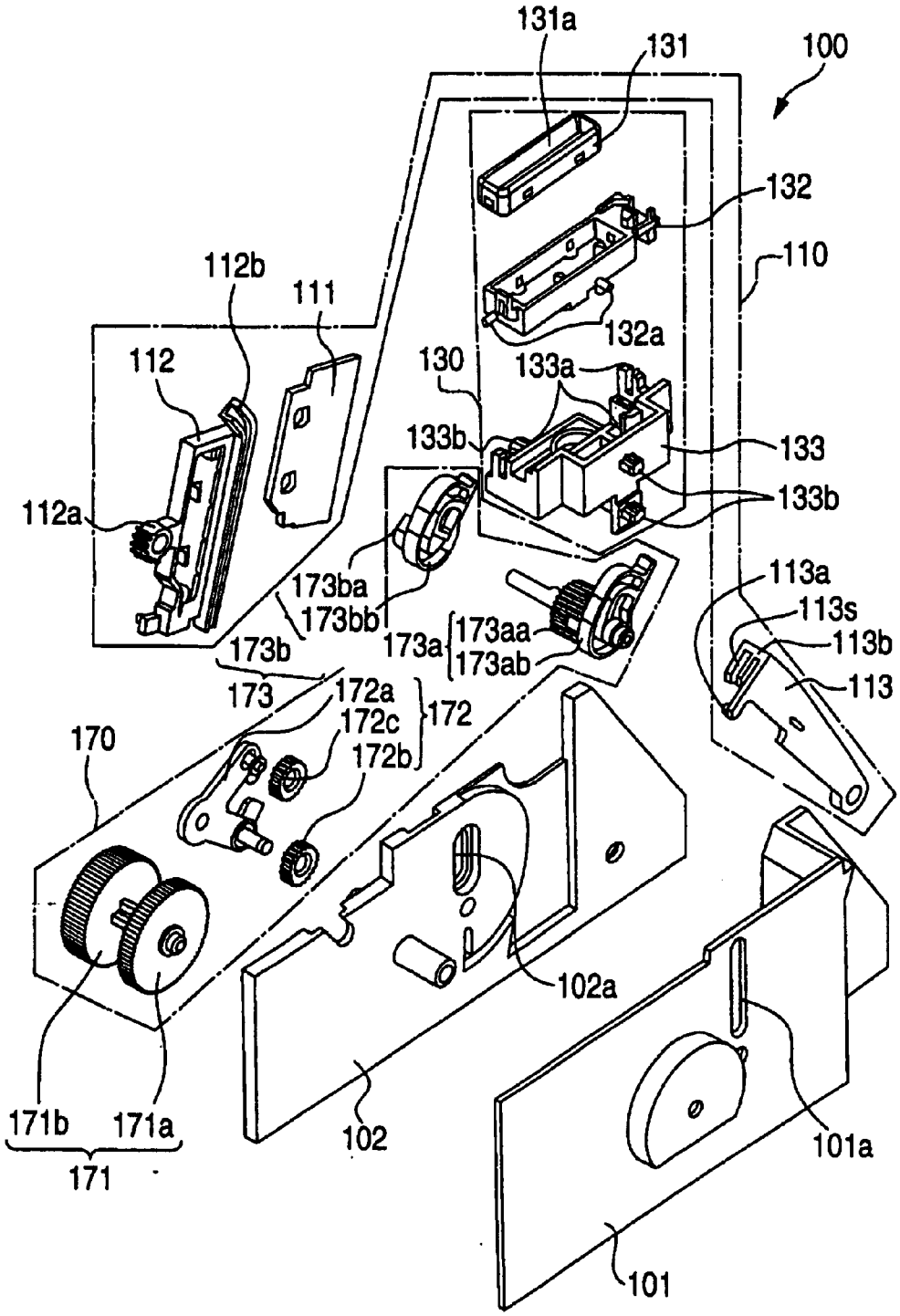
FIG. 4 is an exploded perspective view of the ink ejectability maintenance device shown in FIG. 2.

As shown in FIGS. 2, 3, and 4, the ink ejectability maintenance device 100 has a wiping unit 110, a capping unit 130, a suction unit 150, and driving unit 170 for driving these means. In order to show the internal construction of the ink ejectability maintenance device 100, one side frame 101 shown in FIG. 4 is omitted from FIG. 2. On the other hand, another side frame 102 shown in FIG. 4 is omitted from FIG. 3. Further, in order to simplify an illustration, the suction unit 150 is omitted from FIG. 4.

In the ink ejectability maintenance device 100, interposed between the two side frames 101, 102 are the wiping unit 110 for wiping a nozzle formation face in the main scanning direction of the print head 18 designated by arrow "a" shown in FIGS. 2 and 3; that is, a horizontal direction; the capping unit 130, which is pressed against the nozzle formation face of the print head 18 at the time of non-printing operation, to thereby seal the nozzle orifice; the suction unit 150 for forcefully discharging ink through suction for eliminating clogging in the nozzle orifice or air bubbles intruded into the nozzle orifice; and the driving unit 170 for driving the wiping unit 110 and the capping unit 130 so as to situate at predetermined locations and for driving the suction unit 150. The ink ejectability maintenance device 100 is formed into a substantially-box-shaped unit.

The wiping unit 110 and the capping unit 130 are disposed side by side in the main scanning direction of the print head 18. The suction unit 150 is disposed in a side-by-side relationship with the wiping unit 110 and the capping unit 130 in the sub-scanning direction designated by arrow "b" shown in FIGS. 2 and 3. Further, the driving unit 170 is disposed so that the wiping unit 110, the capping unit 130, and the suction unit 150 can operate in synchronization with each other.

As shown in FIGS. 2, 3, and 4, the wiping unit 110 has a wiper 111, a wiper holder 112, and a wiper cleaner 113. The wiper 111 is formed from rubber into a substantially-rectangular flat plate. The extremity of the wiper 111 rubs against the nozzle formation face of the print head 18. As a result, the wiper 111 can wipe away the ink adhering to the nozzle formation face. The wiper 111 may be formed from felt or plastic, according to the kind of ink.

The wiper holder 112 is formed from plastic into the form of a substantially-rectangular plate. The wiper holder 112 holds the wiper 111 such that the extremity of the wiper 111 projects from the upper end of the wiper holder 112. Further, the wiper holder 112 rotates in the sub-scanning direction around a partially-chipped gear 112*a* which is provided in the lower end of the wiper holder 112 and pivotally supported by a second cap holder 133 of the capping unit 130 to be described later. As a result, the wiper holder 112 can hold the wiper 111 in an upper position when the wiper 111 is used, and in a lower position when the wiper 111 is not used.

The wiper cleaner 113 is formed from plastic into the shape of a blade. While a guide pin 113*a* provided at an upper end of the wiper cleaner 113 is being guided along a guide groove 112*b* formed in the wiper holder 112, the wiper cleaner 113 rotates around a lower end thereof, which is pivotally supported by the side frame 101. An ink scraper 113*b* is provided at the upper end of the wiper cleaner 113 and assumes a U-shaped cross-sectional profile; that is, has a slit 113*s* which has substantially the same thickness as that of the wiper 111. The ink scraper 113*b* rubs against the wiper 111 while the wiper 111 is held in the slit 113*s*.

As mentioned above, the wiper cleaner 113 can scrape away the ink adhering to the wiper 111 without involvement of collision with the wiper 111, by causing the wiper 111 to pass through the slit 113*s* of the ink scraper 113*b*. Hence, there does not arise a faulty operation, which would otherwise be caused by noise such as collision sound. Further, the wiper 111 is not subjected to elastic deformation or restoration. Hence, there does not arise deterioration in recording accuracy, which would otherwise be caused by splashing of ink.

Since the width of the slit 113*s* of the ink scraper 113*b* is set so as to become substantially identical with that of the wiper 111, the ink scraper 113*b* can clean both side surfaces of the wiper 111 where ink particularly tends to remain when the print head 18 is wiped.

The position of the wiper 111 for wiping operation and that of the wiper 111 for non-wiping operation are pivotally determined. During the course of pivot of the wiper 111, the wiper 111 is arranged to pass through the slit 113*s* of the ink scraper 113*b*. The wiper cleaner 113 is constructed such that the guide pin 113*a* is inserted into the guide groove 112*b* formed in the wiper holder 112 so as to follow the wiper holder 112. The wiper cleaner 113 and the wiper 111 move in cooperation with each other.

Consequently, the wiper cleaner 113 can thoroughly wipe away the ink adhering to the area where interference arises between the wiper 111 and the print head 18. After the wiper 111 has wiped the print head 18, the wiper 111 can be cleaned at all times.

As shown in FIGS. 2, 3, and 4, the capping unit 130 is equipped with a cap 131, a first cap holder 132, and a second cap holder 133. The cap 131 is formed from rubber in the form of a substantially rectangular parallelepiped. An indentation 131*a* formed in the top of the cap 131 is pressed against the nozzle formation face of the print head 18. The capping unit 130 can seal the nozzle orifice.

The first cap holder 132 is formed from plastic into the shape of a substantially-rectangular-parallelepiped. An unillustrated spring is held in the second cap holder 133 while retaining the cap 131 such that the upper edge of the cap 131 projects from the upper portion of the first cap holder 132. Projections 132*a* provided on side faces of the first cap holder 132 are engaged with claws 133*a* of the second cap holder 133. Hence, the first cap holder 132 can move minutely in every direction. As a result, the first cap holder 132 can press the upper edge of the cap 131 against the nozzle formation face of the print head 18. Thus, the cap 131 and the print head 18 can be brought into intimate contact with each other without fail.

The second cap holder 133 is formed from plastic into the shape of a substantially-rectangular-parallelepiped. The first cap holder 132 is held on the upper end face of the second cap holder 133. While guide pins 133*b* provided on side faces of the second cap holder 133 are being guided by guide grooves 101*a*, 102*a* formed in the respective side frames 101, 102, the second cap holder 133 moves vertically in conjunction with the wiper 111 and the wiper holder 112. As a result, when the cap 131 is used, the second cap 133 can be fixedly held in an upper position. In contrast, when the cap 131 is not used, the second cap 133 can be fixedly held in a lower position.

The suction unit 150 is a well-known pulsation pump. Upon continuous pushing of a given portion of a tube T connected to the cap 131, by a plurality of rollers provided at given intervals in the rotating direction, air in the tube is fed, thereby forcefully discharging ink from the print head 18 by suction. As a result, the suction unit 150 can eliminate clogging in the nozzle orifice or air bubbles intruded into ink.

As shown in FIGS. 2, 3, and 4, the driving unit 170 has a torque transmitter 171, a switcher 172, and an actuator 173. The torque transmitter 171 has a first gear 171*a* provided outside of the side frame 101, and a second gear 171*b* which is disposed integrally and coaxially with the first gear 171*a* and is interposed between the side frames 101, 102. The first gear 171*a* is connected to an unillustrated motor disposed outside the side frame 101. The second gear 171*b* is meshed with a gear 151 of the suction unit 150 shown in FIG. 2.

The switcher 172 has a substantially-L-shaped switcher arm 172*a*; a forward rotation gear 172*b* rotatably attached to one end of the arm 172*a*; and a reverse rotation gear 172*c* rotatably attached to the remaining end of the same. The center of the switcher arm 172*a* is fitted into the shaft of the second gear 171*b*. The switcher arm 172*a* is pressed against the second gear 171*b*. Depending on the rotating direction of the second gear 171*b*, either the forward rotation gear 172*b* or the reverse rotation gear 172*c* meshes with the second gear 171*b*. Further, the forward rotation gear 172*b* and the reverse rotation gear 172*c* alternately mesh with a partially-chipped gear section 173*aa* of a gear-operated cam 173*a* of the actuator 173 to be described later.

The actuator 173 is provided with two gear-operated cams 173*a*, 173*b* provided coaxially at both side ends of the actuator 173. The gear-operated cam 173*a* is constituted of the partially-chipped gear 173*aa* and a cam section 173*ab*, which are integrated into a piece. The gear-operated cam 173*b* is constituted of a partially-chipped gear 173*ba* and a cam section 173*bb*, which are integrated into a single piece. As mentioned above, the partially-chipped gear 173*aa* is arranged so as to mesh alternately with the forward rotation gear 172*b* and the reverse rotation gear 172*c* of the switcher 172. The partially-chipped gear section 173*ba* is arranged to mesh with the partially-chipped gear 112*a* of the wiper holder 112. The cam sections 173*ab*, 173*bb* are arranged to come into contact with lower portions of the two guide pins 133*b* disposed on both lower sides of the second cap holder 133.

The torque of the motor is transmitted to the wiping unit 110 by way of the first gear 171*a*, the second gear 171*b*, the forward rotation gear 172*b* or the reverse rotation gear 172*c* selected as a result of pivot or rotation of the switcher arm 172*a*, the partially-chipped gear 173*aa* of the gear-operated cam 173*a*, and the partially-chipped gear 173*ba* of the gear-operated cam 173*b*. The torque is transmitted further to the wiping unit 110 and the capping unit 130 by way of the cam section 173*ab* of the gear-operated cam 173*a* and the cam section 173*bb* of the gear-operated cam 173*b*. The torque is transmitted further to suction unit 150 by way of a gear 151. As a result, the wiping unit 110 is rotated, whereby the wiping unit 110 and the capping unit 130 are actuated vertically, thereby activating the suction unit 150.

Figure 5:
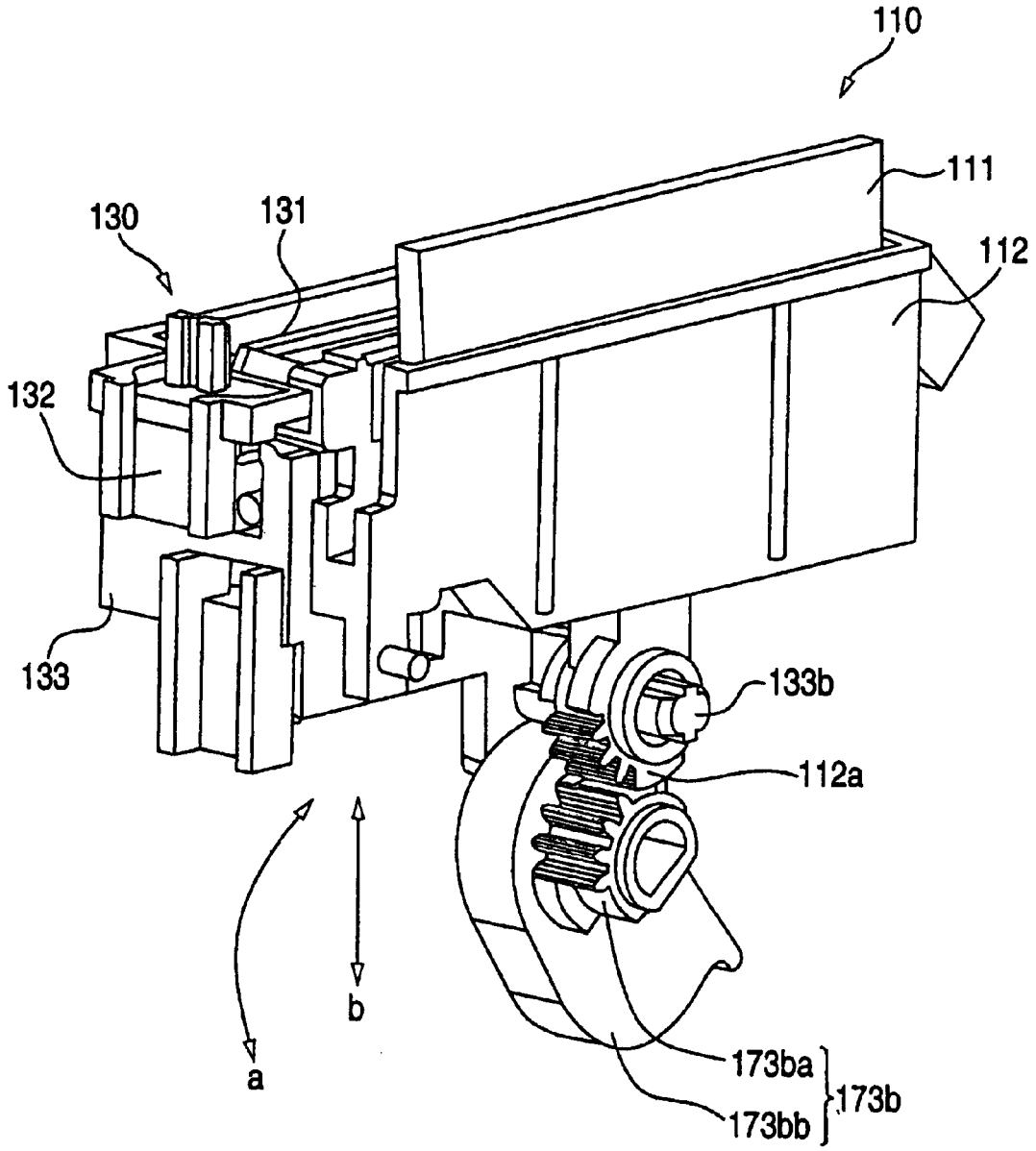
FIG. 5 is a perspective view showing a detailed layout relationship between the principal section of a wiping unit and a gear-operated cam of a capping unit of the ink ejectability maintenance device.

A layout relationship between the principal section of the wiping unit 110 having the foregoing configuration and the gear-operated cam 173*b* of the capping unit 130 will be described in detail by reference to FIG. 5. Subsequently, the operation of the wiping unit 110 and that of the capping unit 130 will be described by reference to FIGS. 6 through 21. As shown in FIG. 5, a guide pin 133*b* provided on the second cap holder 133 of the capping unit 130 is inserted into a shaft hole of the partially-chipped gear 112*a* provided on the wiper holder 112 of the wiping unit 110.

The gear-operated cam 173*b* is arranged such that the partially-chipped gear 173*ba* meshes with the partially-chipped gear 112*a* of the wiper holder 112 and such that the cam section 173*bb* comes into contact with the guide pin 133*b* provided on the second cap holder 133. The wiping unit 110 pivots in the direction designated by arrow "a," and the capping unit 130 can be vertically actuated along with the wiping unit 110 in the direction designated by arrow "b."

Figure 10:
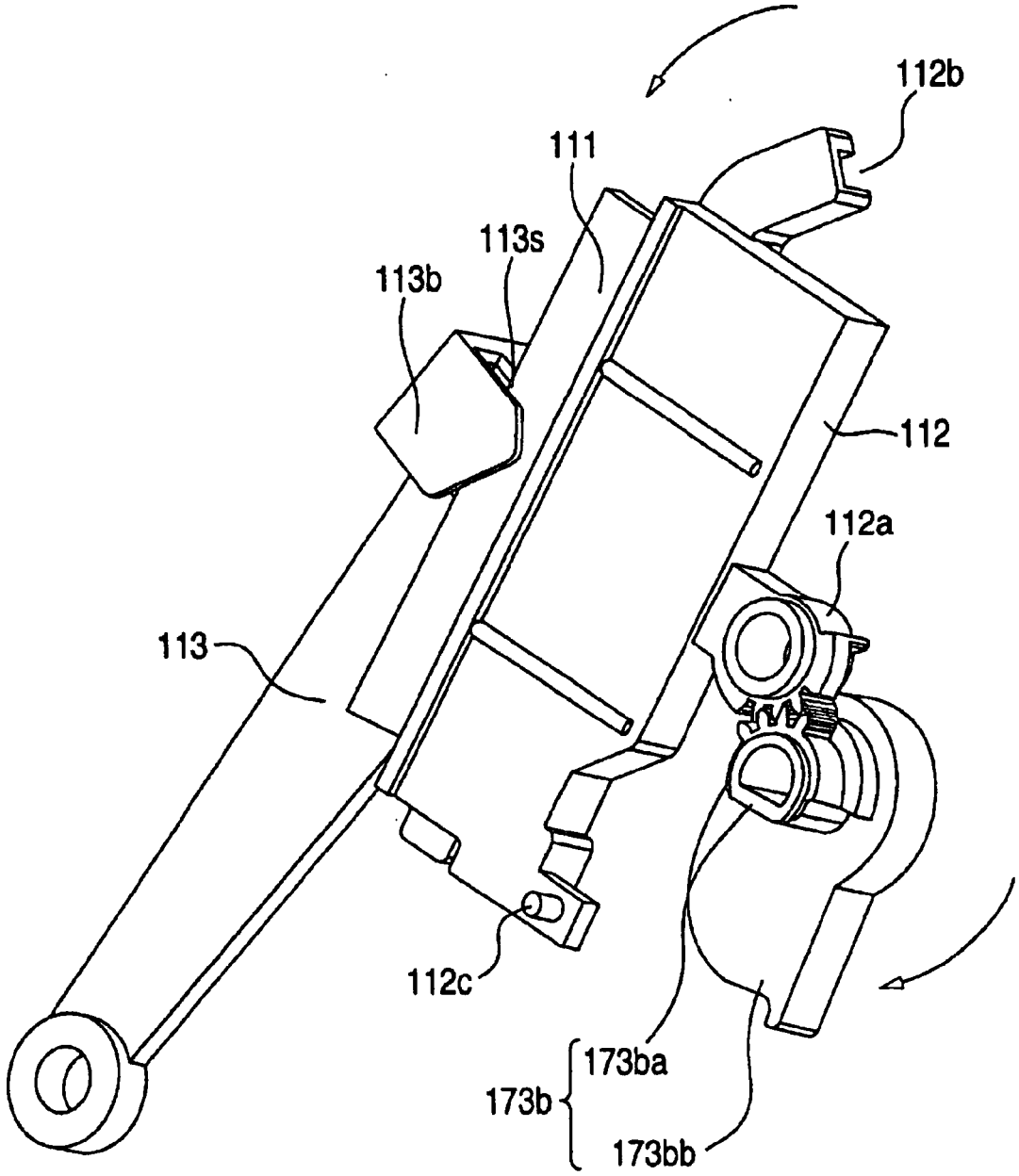
Figure 11:
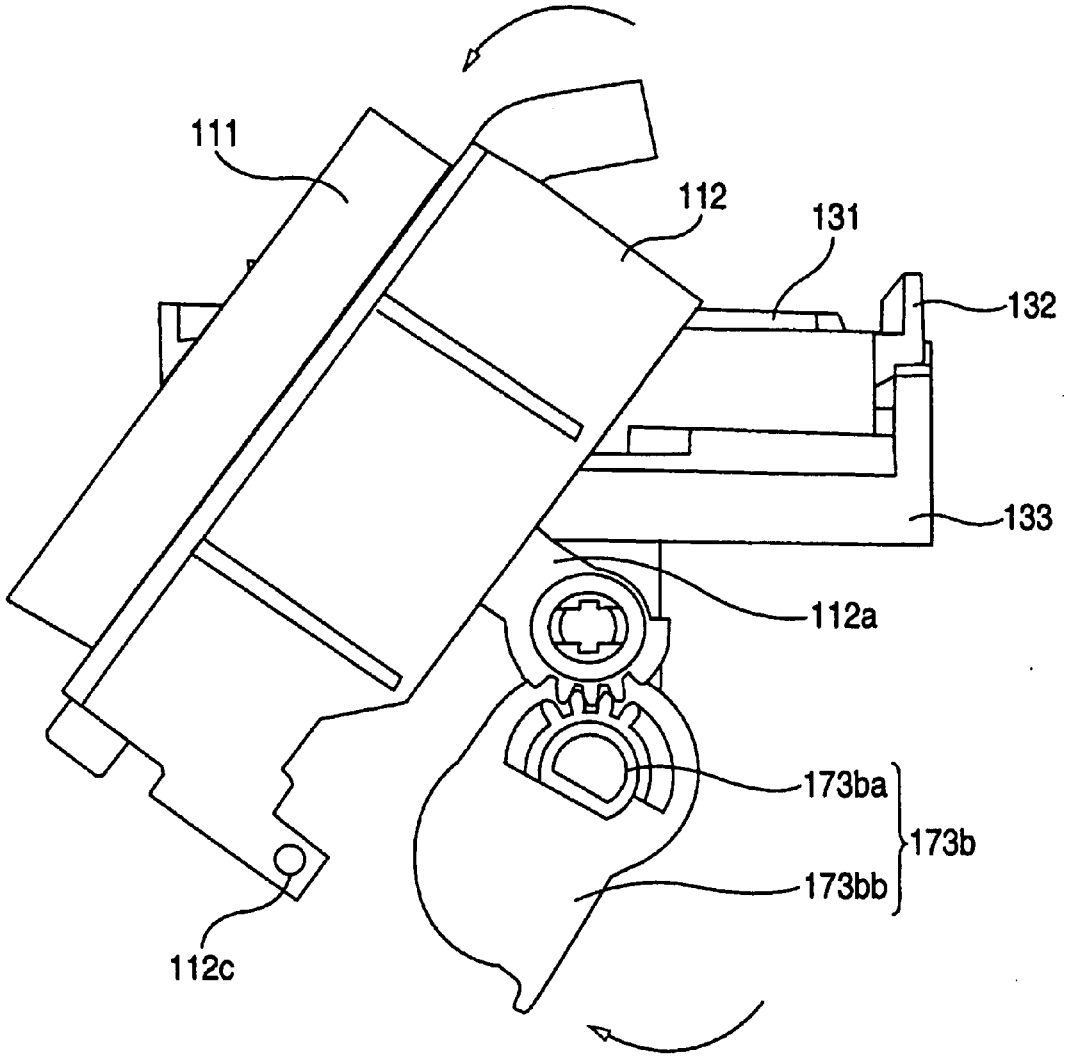
Figure 12:
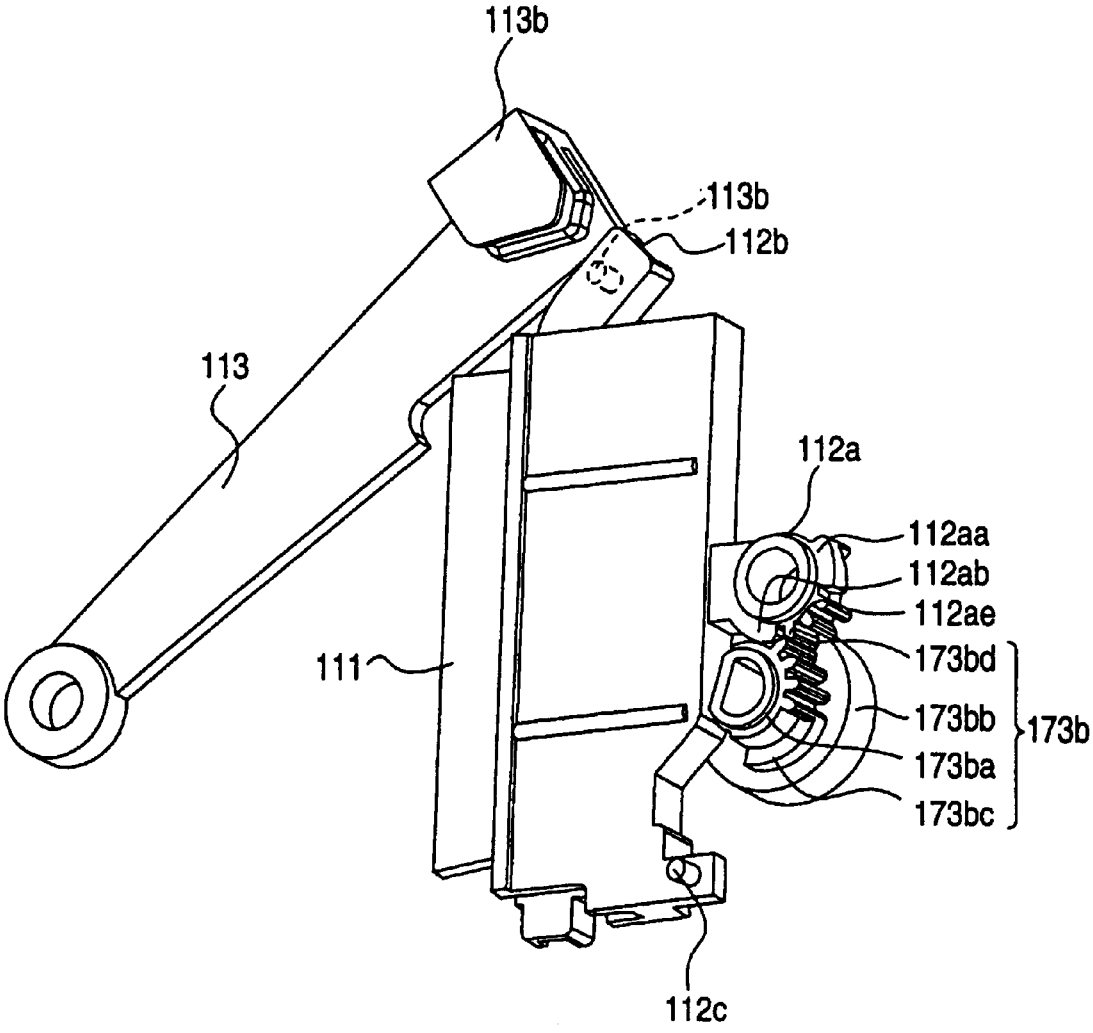
Figure 13:
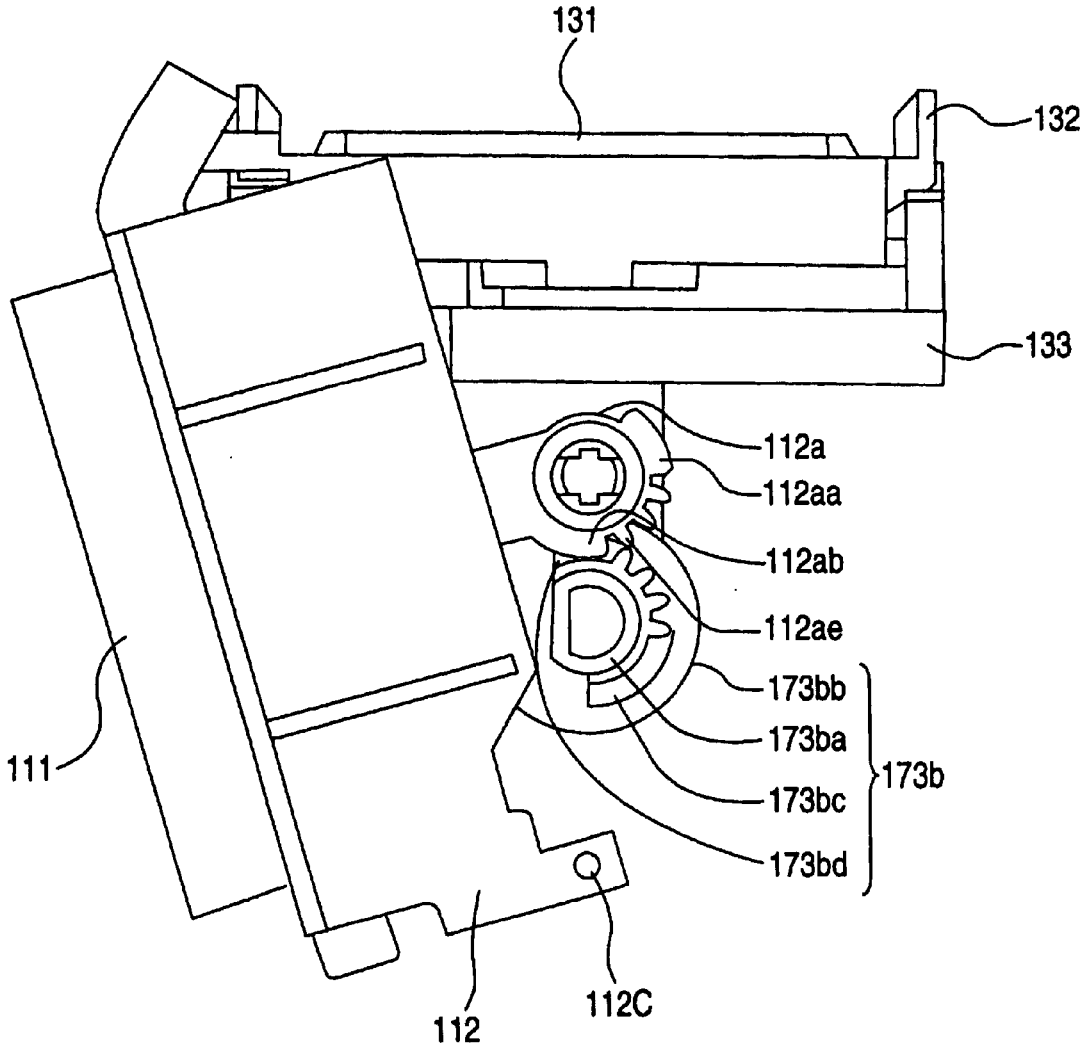
Figure 14:
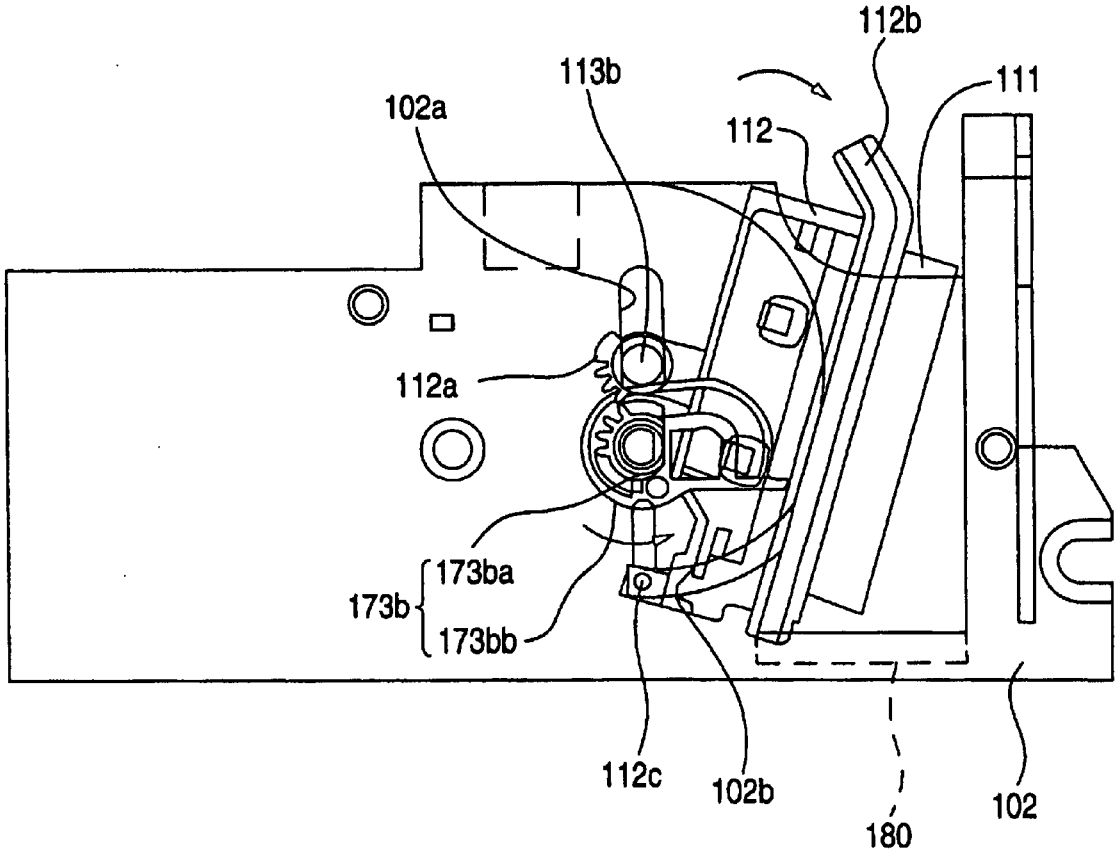
Figure 15:
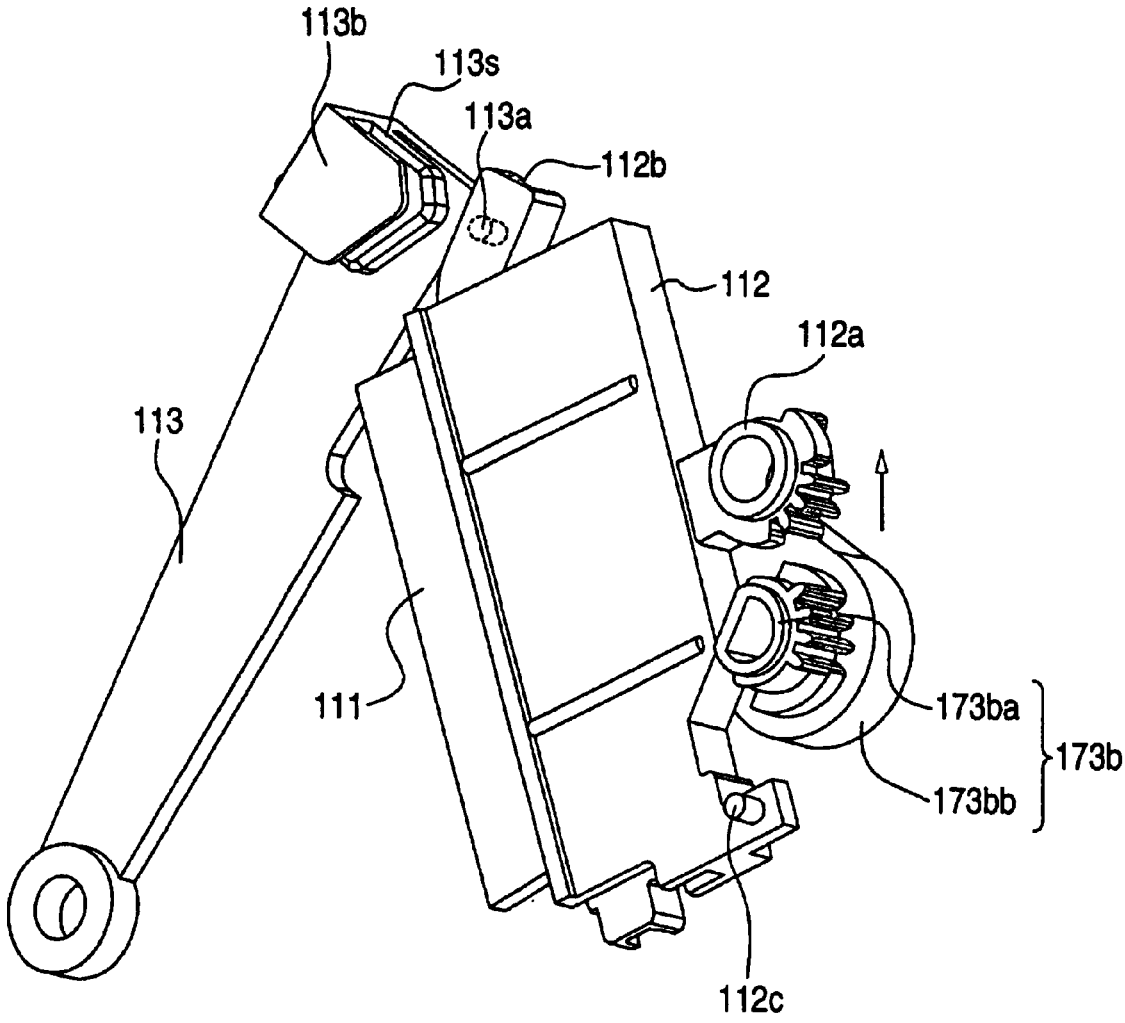
Figure 16:
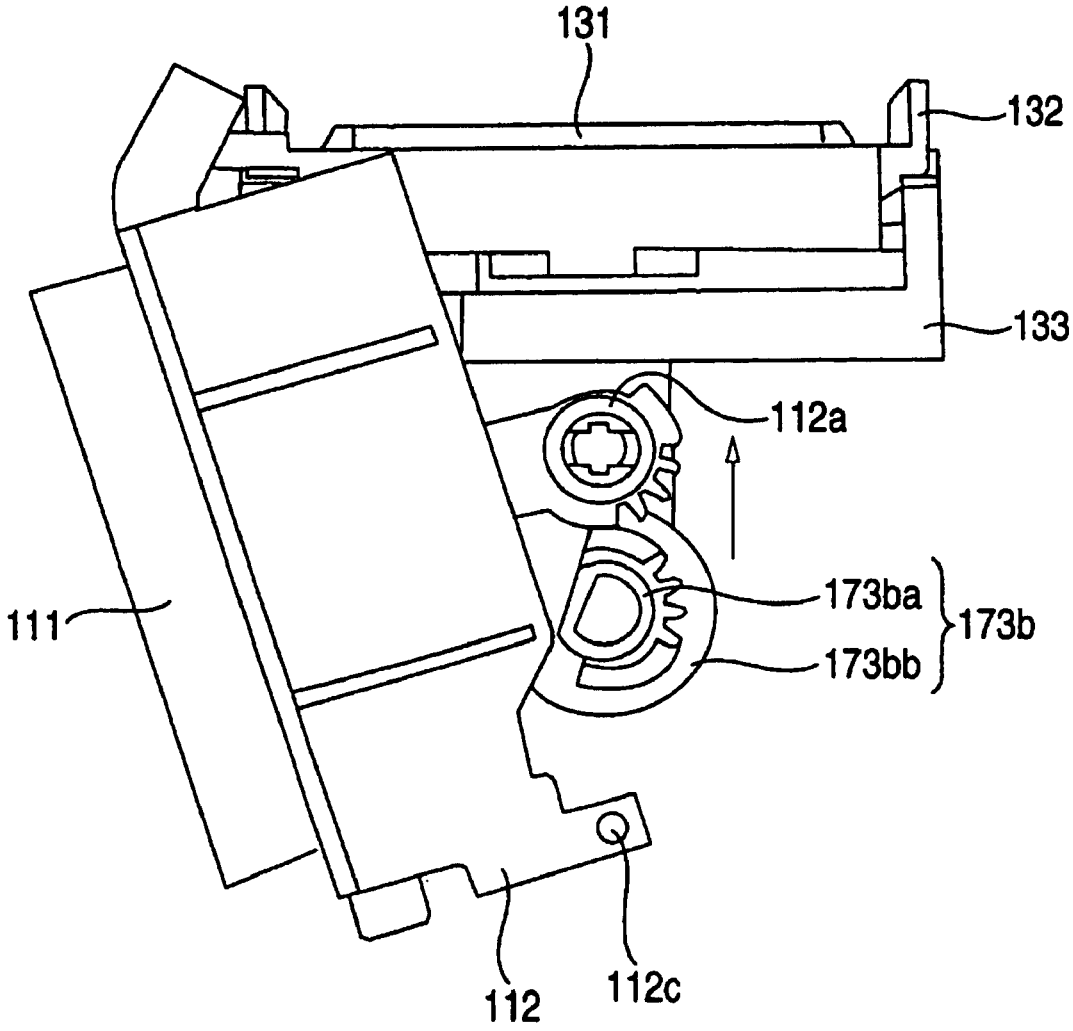
Figure 17:
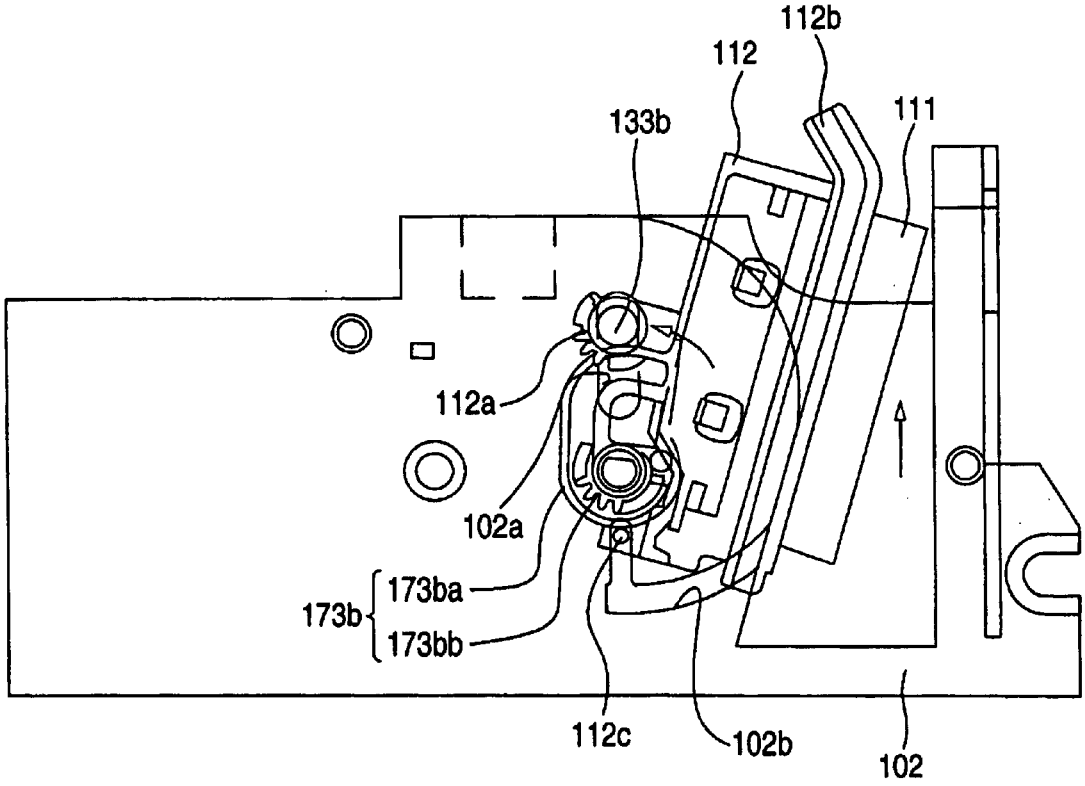

Next, the operation of the wiping unit 110 will be described by reference to FIGS. 6 through 17. FIGS. 6 through 9, FIGS. 10 and 11, FIGS. 12 through 14, and FIGS. 15 through 17 show a single operating status when viewed from different points. More specifically, FIGS. 6 through 9 show a state in which the wiper 111 can perform a wiping operation. FIGS. 10 and 11 show a state in which the wiper 111 is in the course of being housed. FIGS. 12 through 14 show a state in which housing of the wiper 111 is completed. FIGS. 15 through 17 show a state in which the wiping unit 110 rises along with the capping unit 130.

Figure 6:
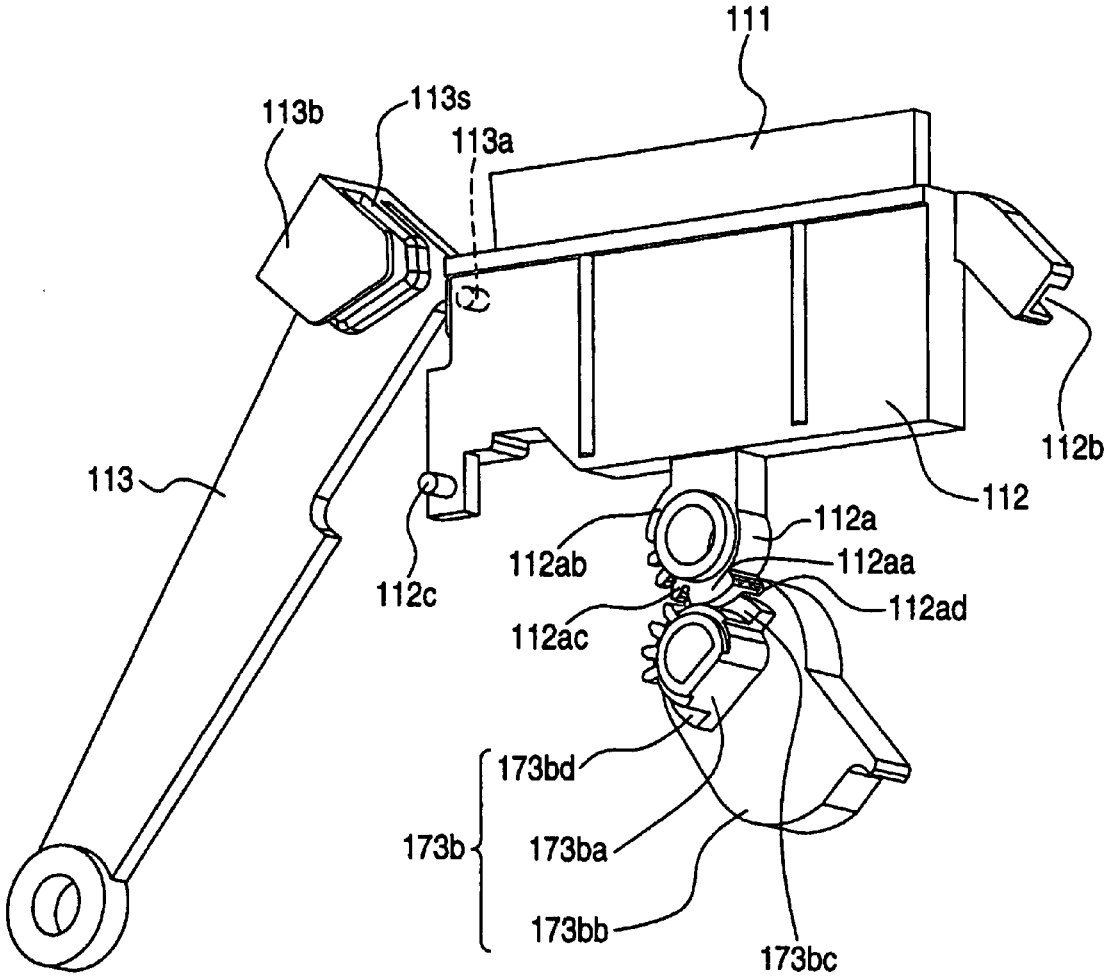
FIGS. 6 through 17 are diagrams showing the operation of the wiping unit shown in FIG. 5.

In a state in which the wiper 111 can perform a wiping operation, the wiper 111 is fixedly positioned so as to face upward, as shown in FIG. 6. The wiper cleaner 113 is fixedly positioned to one end of the wiper holder 112. The positioning is effected in the following manner.

Figure 8:
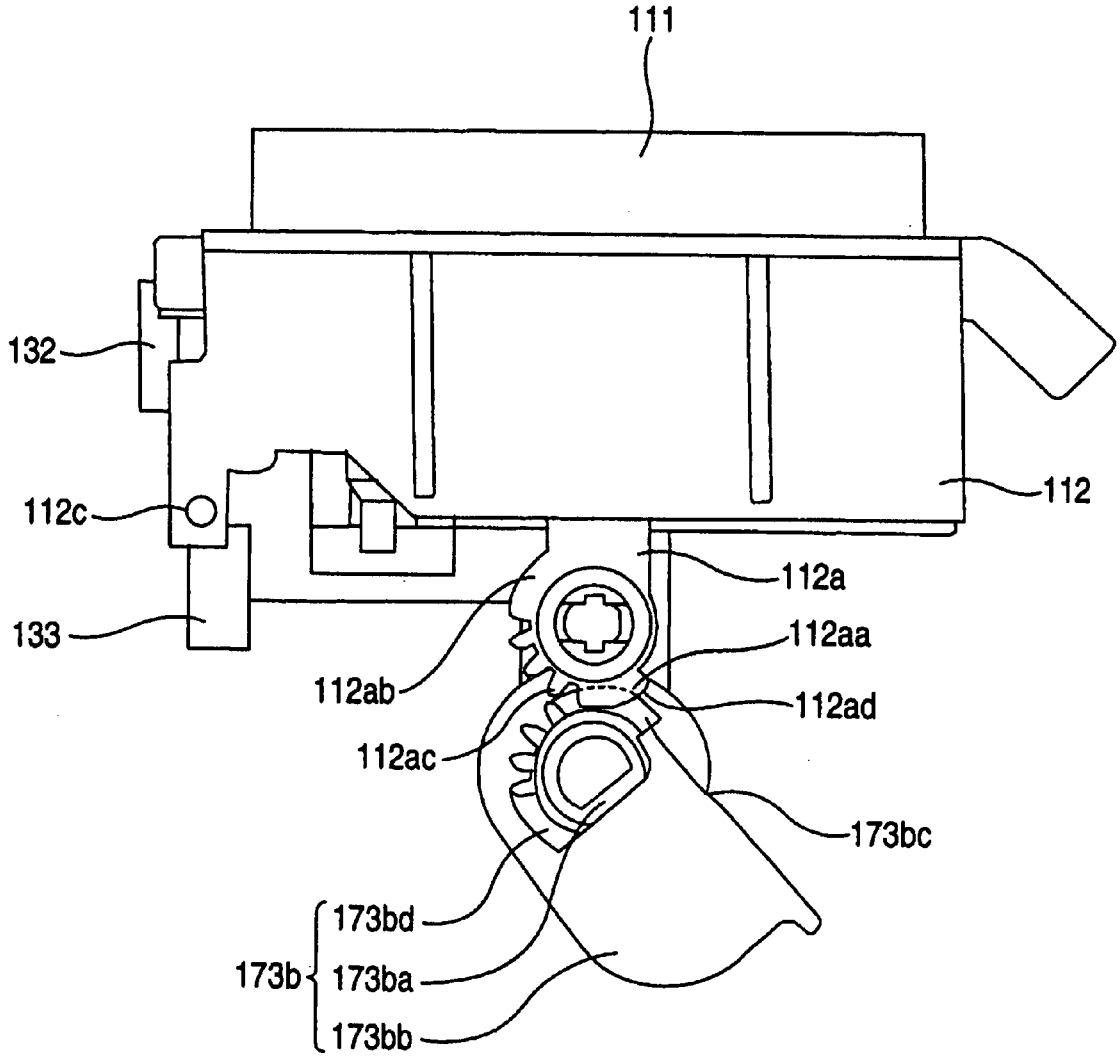

As shown in FIGS. 6 and 8, arc-shaped portions 112*aa* and 112*ab* which have a thickness half or smaller than that of gear teeth and a radius equal to or greater than that of an addendum circle defined by the gear teeth are formed in predetermined areas extending from the respective ends of a teeth-formed section of the partially-chipped gear 112*a* provided in the wiper holder 112. Contrary to the arc-shaped portions 112*aa*, 112*ab*, arc-shaped portions 173*bc*, 173*bd* which have a thickness equal to or smaller than that of gear teeth and a radius greater than that of an addendum circle defined by the gear teeth are formed in predetermined areas extending from the respective ends of the teeth-formed section of the partially-chipped section 173*ba* provided in the gear-operated cam 173*b*.

As shown in FIGS. 6 and 8, one arc-shaped portion 112*aa* of the partially-chipped gear 112*a* meshes with one arc-shaped portion 173*bc* of the partially-chipped gear 173*ba*. The arc-shaped portion 173*bc* is sandwiched between both ends of the arc-shaped portion 112*aa*: that is, between a teeth 112*ac* provided at the end of the partially-chipped gear 112*a* and a wall section 112*ad* of the arc-shaped portion 112*aa*. As a result, the wiper holder 112 is positioned relative to the gear-operated cam 173*b*, and hence the wiper 111 can be fixedly positioned so as to face upward.

Figure 7:
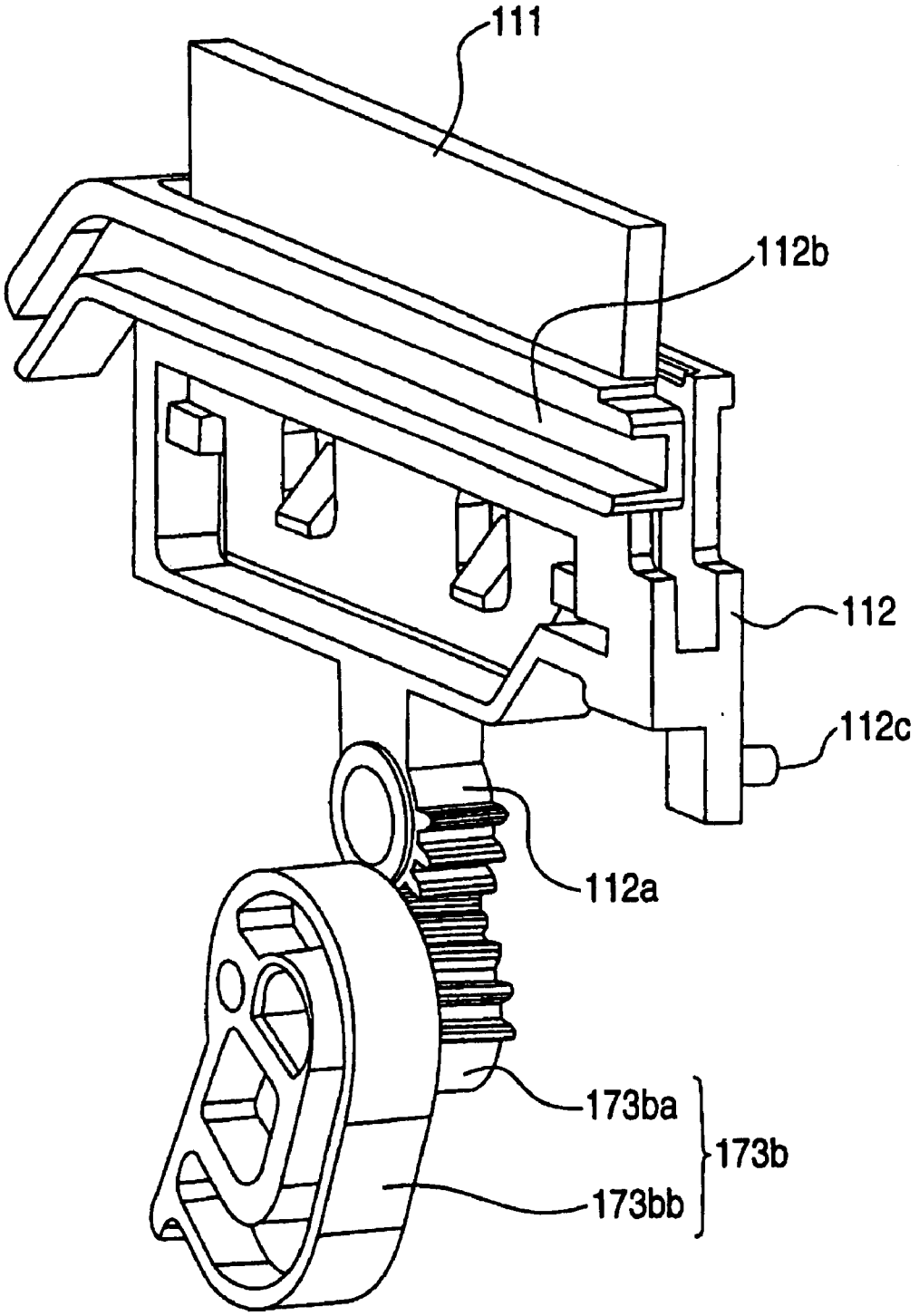

As shown in FIG. 6, the guide pin 113*a* of the wiper cleaner 113 is fitted into the guide groove 112*b* formed in the wiper holder 112 shown in FIGS. 6 and 7. As a result, the wiper cleaner 113 is positioned relative to the wiper holder 112, and hence the wiper cleaner 113 can be fixedly positioned at the end of the wiper holder 112.

Figure 9:
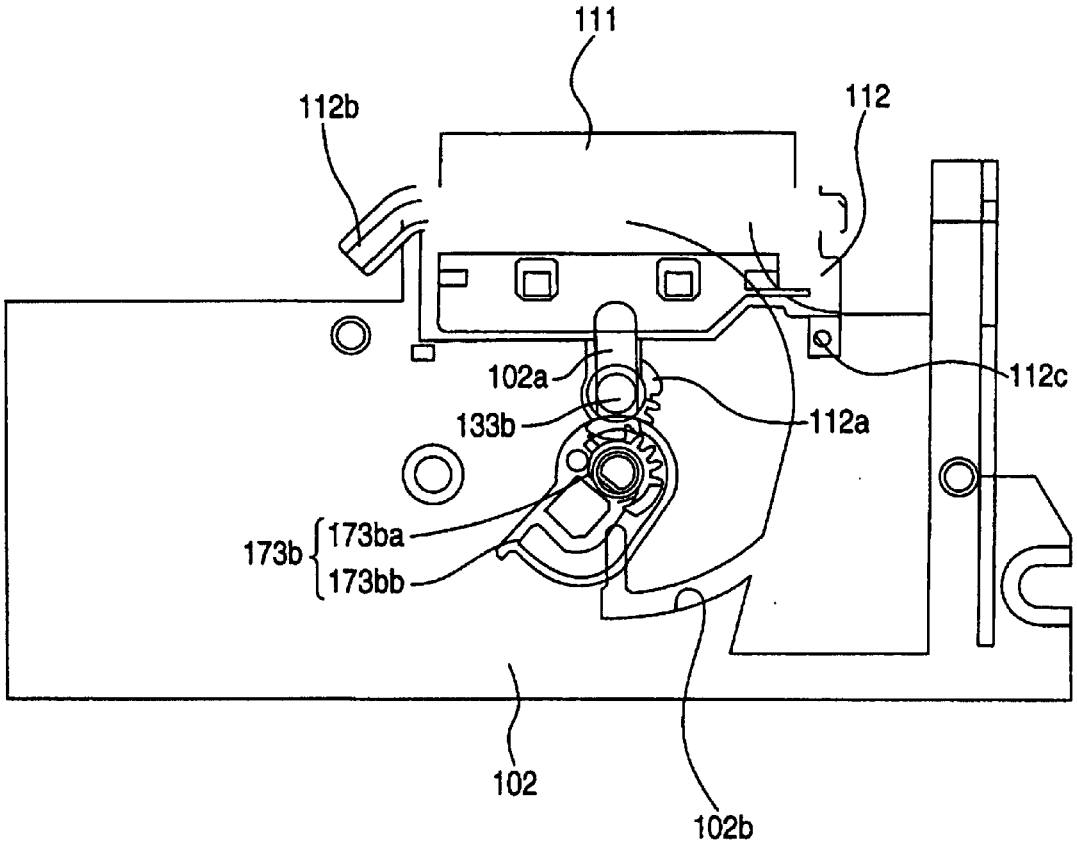

FIG. 9 shows the layout relationship between a guide pin 112*c* provided in the wiper holder 112 so as to act as a guide when the wiper holder 112 pivots and the guide groove 102*b* is formed in the side frame 102. In the state at this time: that is, a state in which the wiper 111 can perform a wiping operation, the guide pin 112*c* and the guide groove 102*b* are separated from each other and remain inoperative.

As shown in FIG. 10, during the course of the wiper 111 being housed, the wiper holder 112 becomes inclined, whereby the wiper 111 is caught by the ink scraper 113*b* of the wiper cleaner 113. As shown in FIGS. 10 and 11, the gear-operated cam 173*b* rotates, and the partially-chipped gear 173*ba* of the gear-operated cam 173*b* meshes with the partially-chipped gear 112*a* of the wiper holder 112. As a result, the wiper holder 112 per se rotates, and the guide pin 113*a* of the wiper cleaner 113 is guided by the guide groove 112*b* of the wiper holder 112. Consequently, the wiper scraper 113*b* of the wiper cleaner 113 holds and rubs against the wiper 111. The wiper 111 can be housed while the ink adhering to the wiper 111 is being wiped away.

As shown in FIG. 12, when housing of the wiper 111 is completed, the wiper 111 is fixedly positioned so as to face a downwardly slanting direction. The wiper cleaner 113 is fixedly positioned on the upper end of the wiper holder 112. The positioning of the wiper cleaner 113 is effected by the following operation.

In a state in which the wiper 111 is housed as shown in FIGS. 12 and 13, when an attempt is made to move the wiper 111 in a setting direction (to the wiping position), a tooth 112*ae* provided at the end of the partially-chipped gear 112*a* comes into collision with the arc-shaped portion 173*bd* of the partially-chipped gear 173*ba* of the gear-operated cam 173*b*. Hence, the wiper 111 cannot be moved in the setting direction.

In a state as shown in FIG. 14, when an attempt is made to move the wiper 111 in a resetting direction as indicated by arrows in this figure, the guide pin 112*c* of the holder 112 comes into collision with the wall of the guide groove 102*a* of the side frame 102 (the left wall in this figure). Hence, the wiper 111 cannot be moved in the resetting direction. As a result, the wiper holder 112 is positioned relative to the gear-operated cam 173*b* and the side frame 102. Hence, the wiper 111 can be fixedly positioned so as to face a downwardly slanting direction.

As shown in FIG. 12, the guide pin 113*a* of the wiper cleaner 113 is positioned at the upper end of the guide groove 112*b* of the wiper holder 112. Therefore, the wiper cleaner 113 can be fixedly positioned relative to the wiper holder 112.

Finally, when the wiping unit 110 has risen along with the capping unit 130, the wiper 111 is fixedly positioned while being oriented in a downwardly slanting direction and spaced apart from the gear-operated cam 173*b*. The wiper cleaner 113 is fixedly positioned on the upper end of the wiper holder 112. Fixed positioning of the wiper cleaner 113 is effected by the following operation.

As shown in FIG. 17, as a result of rotation of the gear-operated cams 173*a*, 173*b*, the cam sections 173*ab*, 173*bb* of the gear-operated cams 173*a*, 173*b* raise the guide pins 133*b* of the second cap holder 133 along the guide grooves 101*a*, 102*a*.

As shown in FIG. 17, the guide pin 112*c* of the wiper holder 112 enters a vertical portion of the guide groove 102*a* of the side frame 102. As a result, the wiper holder 112 is positioned relative to the gear-operated cams 173*a*, 173*b* and the side frame 102. Hence, the wiper 111 can be fixedly positioned while being oriented to a downward slanting direction and spaced apart from the gear-operated cams 173*a*, 173*b*.

On the other hand, as shown in FIG. 15, the guide pin 113*a* of the wiper cleaner 113 has been moved to the upper end of the guide groove 112*b* of the wiper holder 112 so that the wiper cleaner 113 is fixedly positioned relative to the wiper holder 112.

Figure 18:
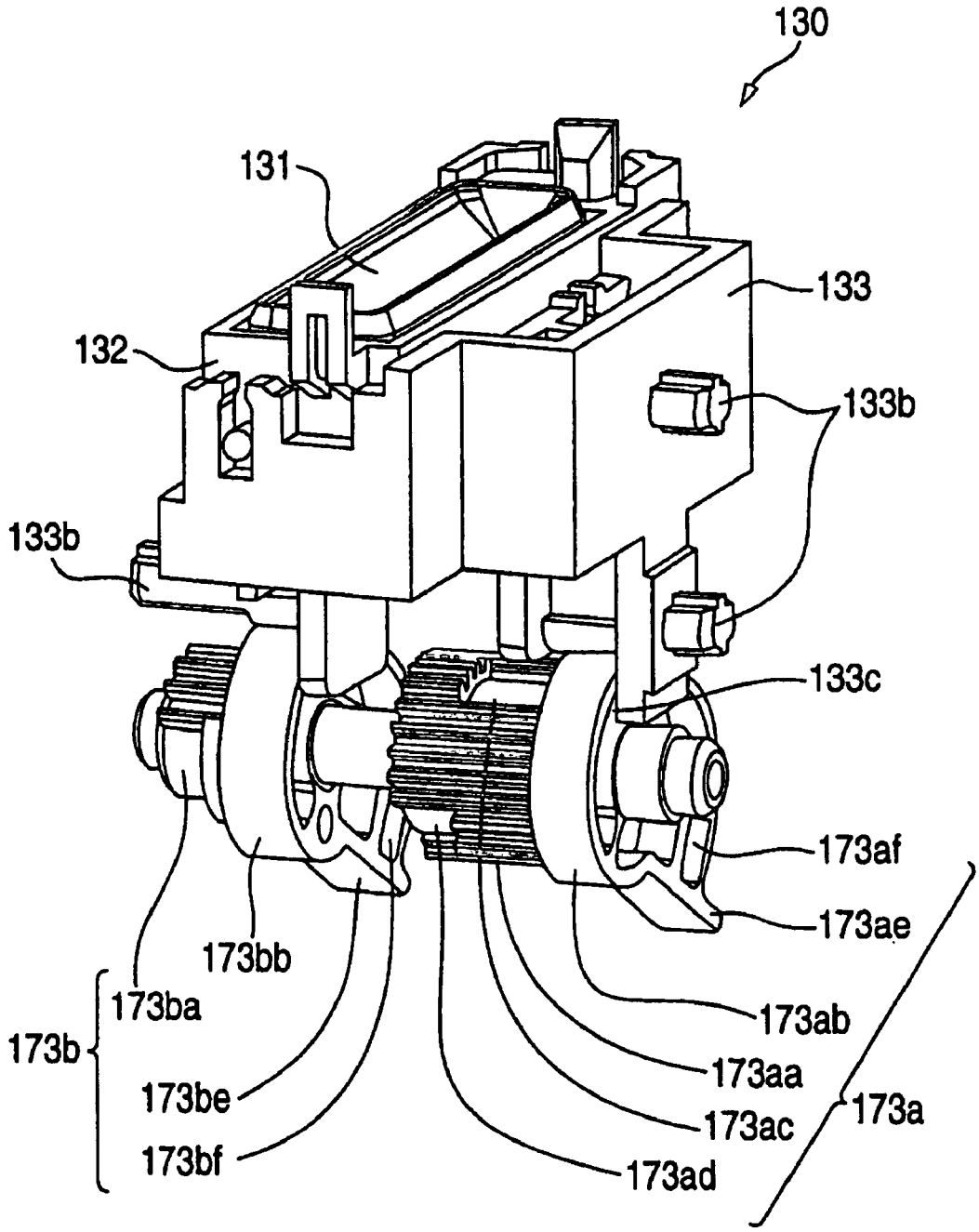
FIGS. 18 through 21 are diagrams showing the operation of the capping unit shown in FIG. 5.
Figure 19:
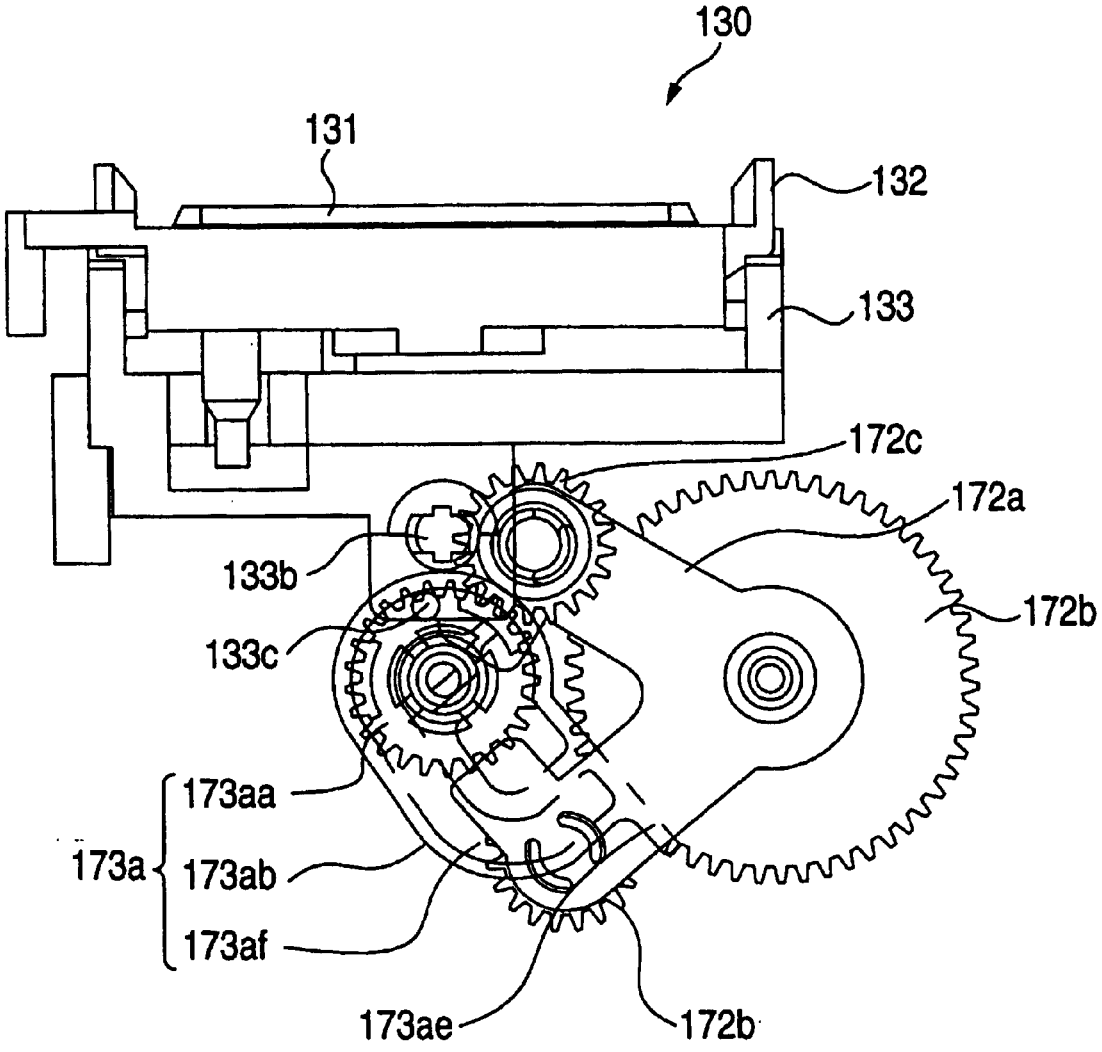
Figure 20:
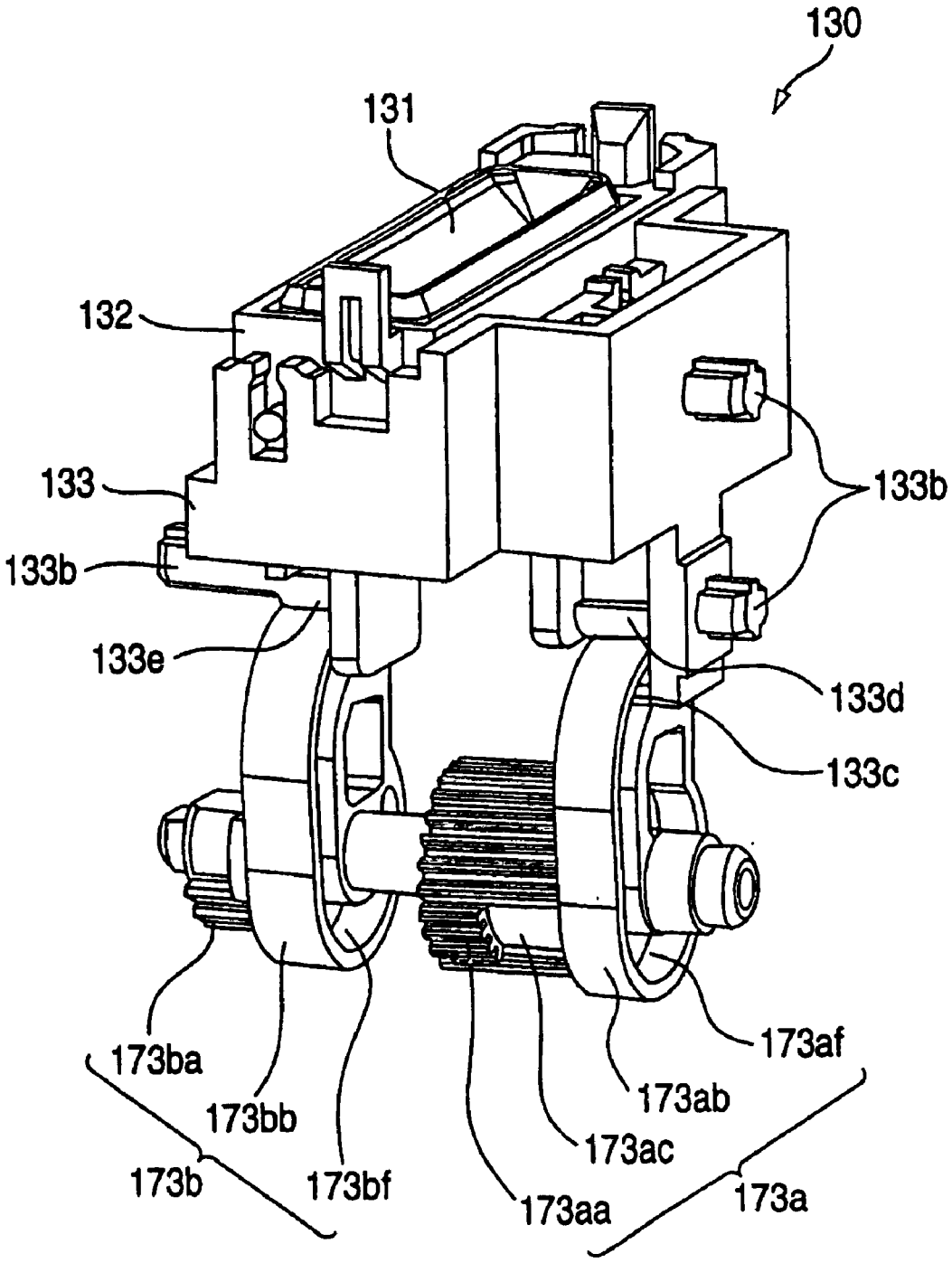
Figure 21:
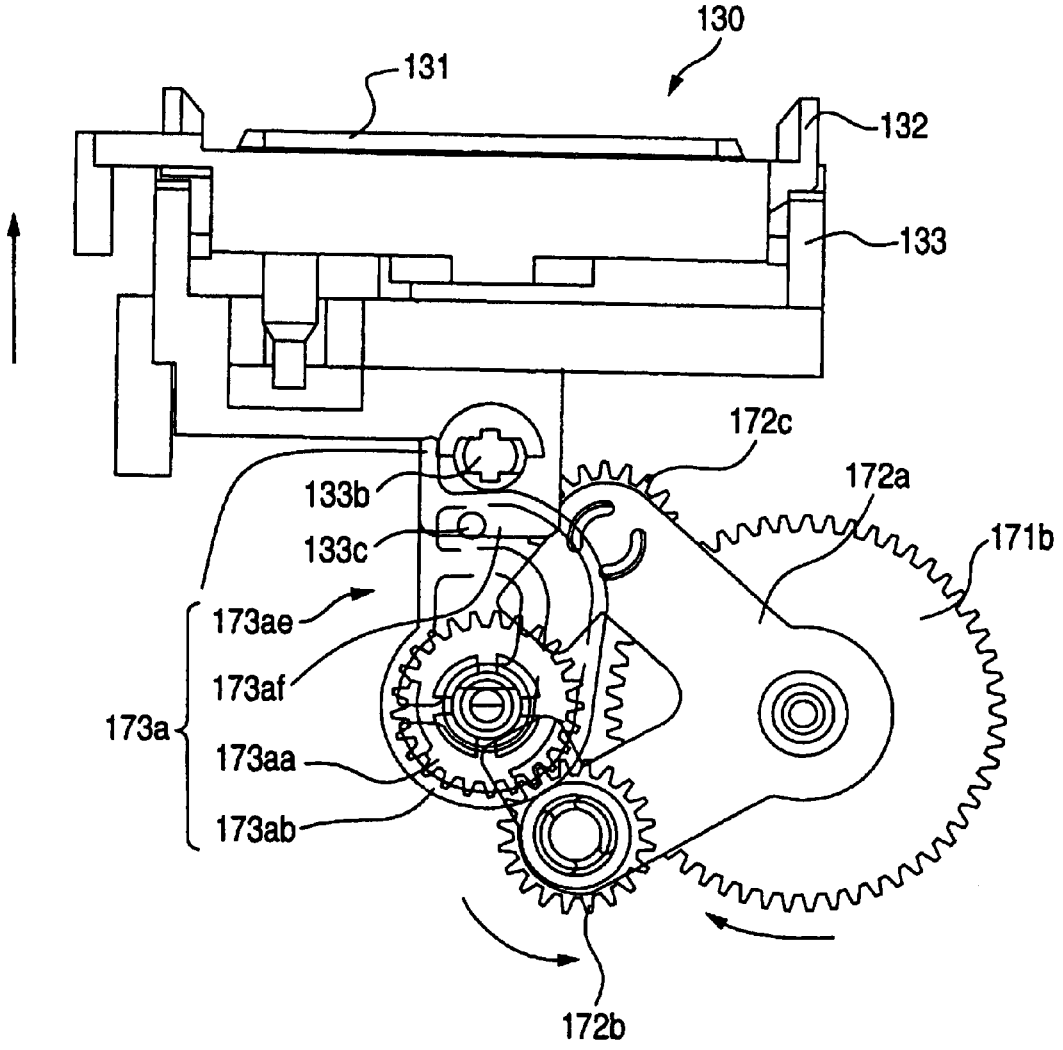

The operation of the capping unit 130 will now be described by reference to FIGS. 18 through 21. FIGS. 18, 19 and FIGS. 20, 21 show a single operating status from different view points. More specifically, FIGS. 18, 19 show completion of housing of the cap 131, and FIGS. 20, 21 show a state in which the cap 131 can perform a capping operation.

As shown in FIGS. 18 and 19, the capping unit 130 is fixedly positioned on the lowermost end of the cap 131. Positioning of the capping unit 130 is performed by the following operation. As shown in FIG. 18, the partially-chipped gear section 173*aa* of the gear-operated cam 173*a* is arranged such that the forward rotation gear 172*b* and the reverse rotation gear 172*c* alternately mesh with a position on the partially-chipped gear section 173*aa* offset in the widthwise direction thereof, by pivot of the switcher arm 172*a*. Two tooth-chipped sections 173*ac*, 173*ad* are formed on the partially-chipped gear 173*aa* so as to become spaced apart from each other in both circumferential and widthwise directions thereof.

As shown in FIGS. 18 and 19, cam sections 173*ab*, 173*bb* of the gear-operated cams 173*a*, 173*b* are formed into substantially the shape of an oval. A stopper 173*ae* capable of coming into contact with one of the two guide pins 133*b*, 133*b* provided on the respective lower sides of the second cap holder 133 is provided at any point on the cam section 173*ab*. Similarly, a stopper 173*be* capable of coming into contact with the remaining guide pin 133*b* is provided at any point on the cam section 173*bb*. Further, a guide groove 173*af* is formed in the side face of the cam 173*a*, wherein one of the two other guide pins 133*c*, 133*c* provided on the second cap holder 133 is guided along the outer periphery of one of the two other guide pins 133*c*, 133*c* provided in the second cap holder 133.

When the capping unit 130 has reached the lowermost end from the uppermost end, a guide groove 173*af* of a cam section 173*ab* of the gear-operated cam 173*a* and a guide groove 173*bf* of a cam section 173*bb* of the gear-operated cam 173*b* move the two guide pins 133*c* of the second cap holder 133. The two guide pins 133*b* provided on both lower portions of the second cap holder 133 are pushed down to the lowermost end along the guide groove 101*a* of the side frame 202 and the guide groove 102*a* of the side frame 102.

The reverse rotation gear 172*c* runs idle while meshing with the tooth-chipped section 173*ad* of the partially-chipped gear 173*aa* of the gear-operated cam 173*a*. As a result, the second cap holder 133 is fixedly positioned relative to the side frames 101, 102 of the gear-operated cams 173*a*, 173*b*. Hence, the capping unit 130 can be fixedly positioned at the lowermost end.

In a state in which the cap 131 can perform a capping operation, the capping 130 is fixedly position at the uppermost end location, as shown in FIGS. 20 and 21. When the capping unit 130 has reached the highest position from the lowermost position, the cam section 173*ab* of the gear-operated cam 173*a* and the cam section 173*bb* of the gear-operated cam 173*b* move the two guide pins 133*d*, 133*e* of the second cap holder 133. Then, the two guide pins 133*b* provided on both sides of the second cap holder 133 are raised to the uppermost end potions so as to come into contact with the stoppers 173*ae*, 173*be* along the guide groove 101*a* of the side frame 101 and the guide groove 102*b* of the side frame 102.

The forward rotation gear 173*b* runs idle while meshing with the teeth-lacking section 173*ac* of the partially-chipped gear 173*aa* of the gear-operated cam 173*a*. As a result, the second cap holder 133 is positioned relative to the gear-operated cams 173*a*, 173*b* and the side frames 101, 102. Hence, the capping unit 130 can be fixedly positioned on the uppermost end location.

Figure 22:
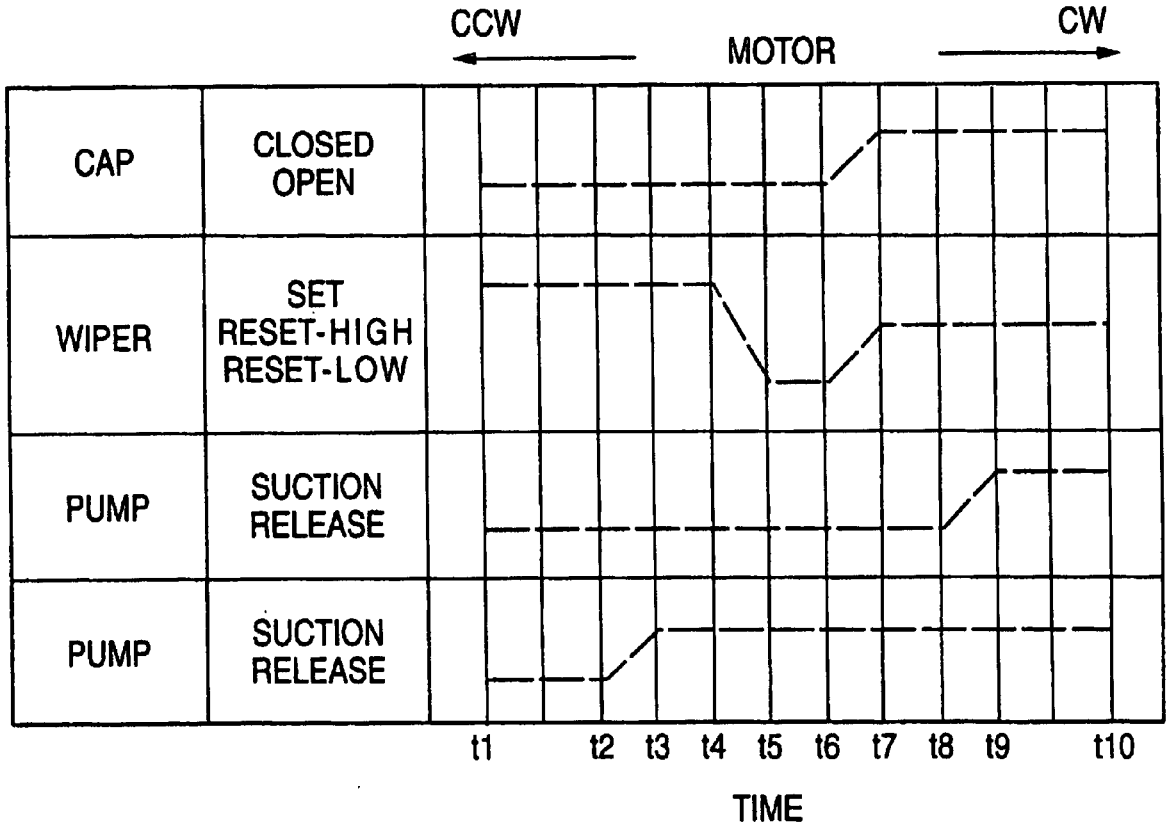
FIG. 22 is a timing chart showing the whole operation of the ink ejectability maintenance device shown in FIG. 2.
Figure 23:
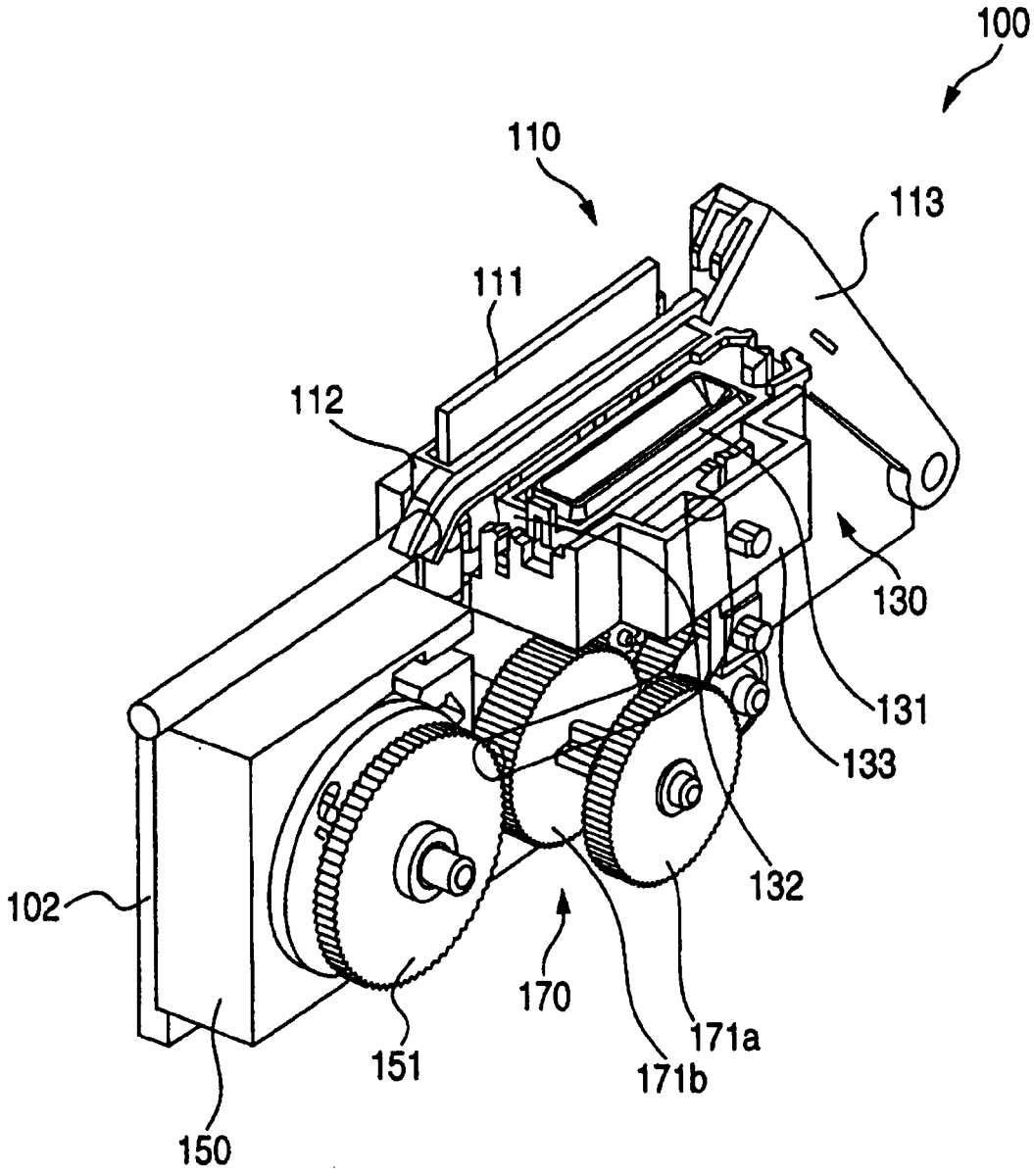
FIGS. 23 through 31 are diagrams showing the whole operation of the ink ejectability maintenance device shown in FIG. 2.
Figure 24:
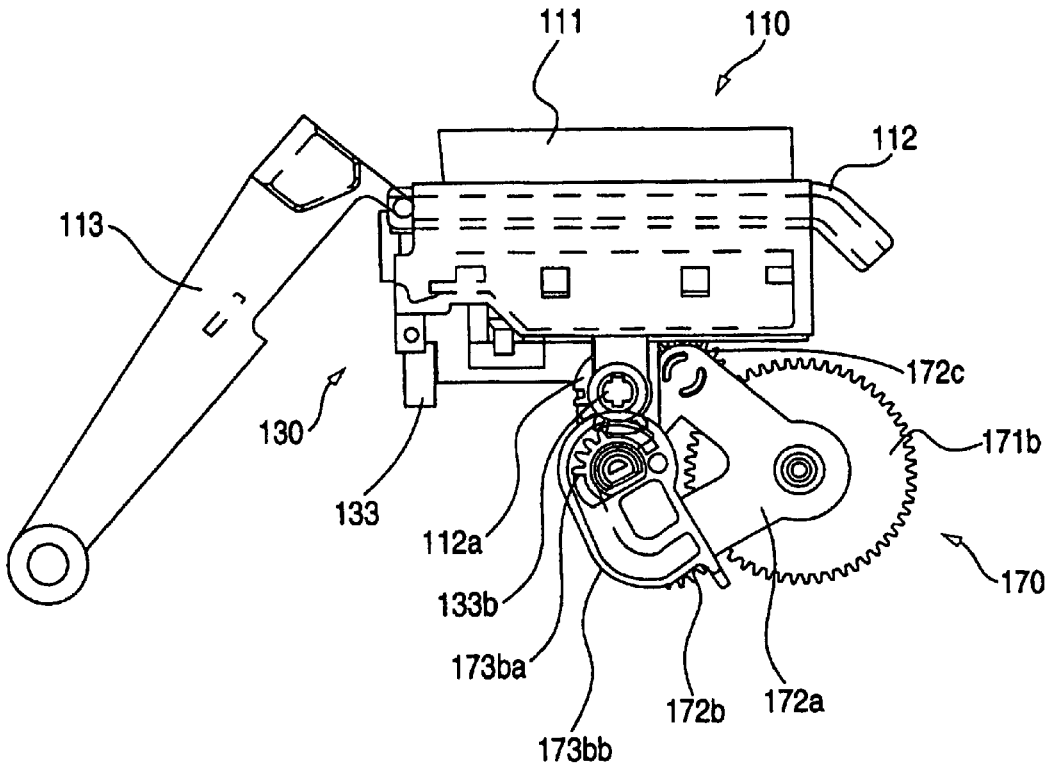
Figure 25:
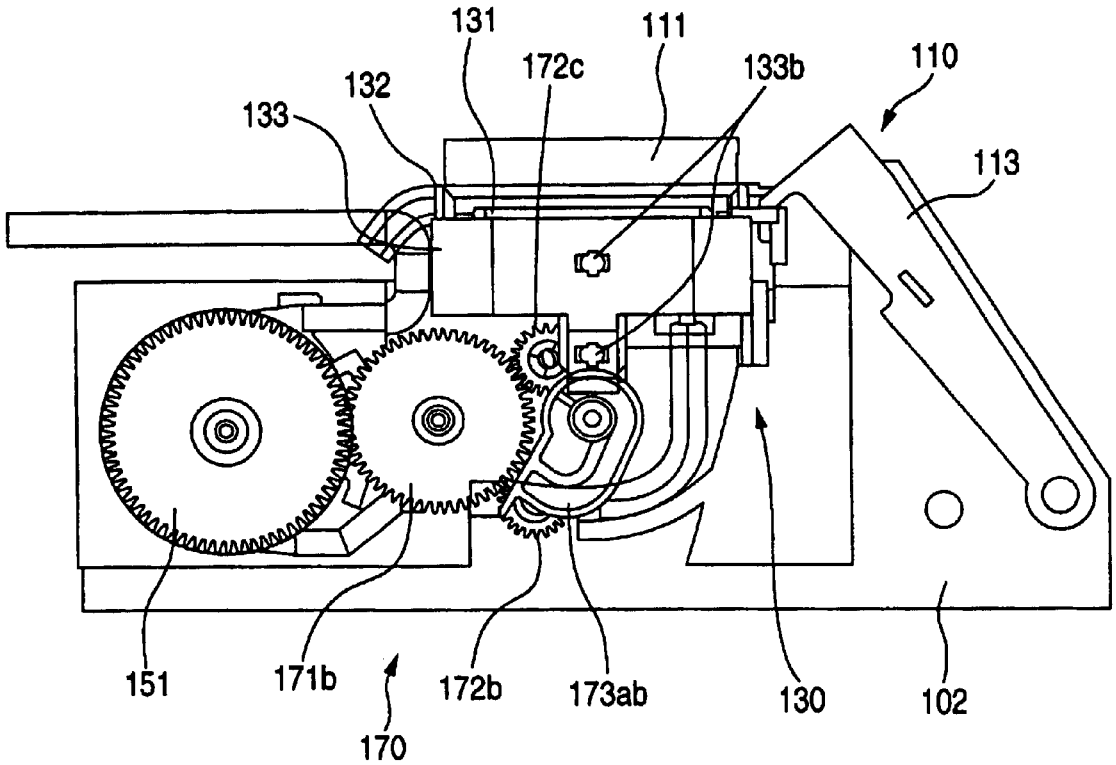
Figure 26:
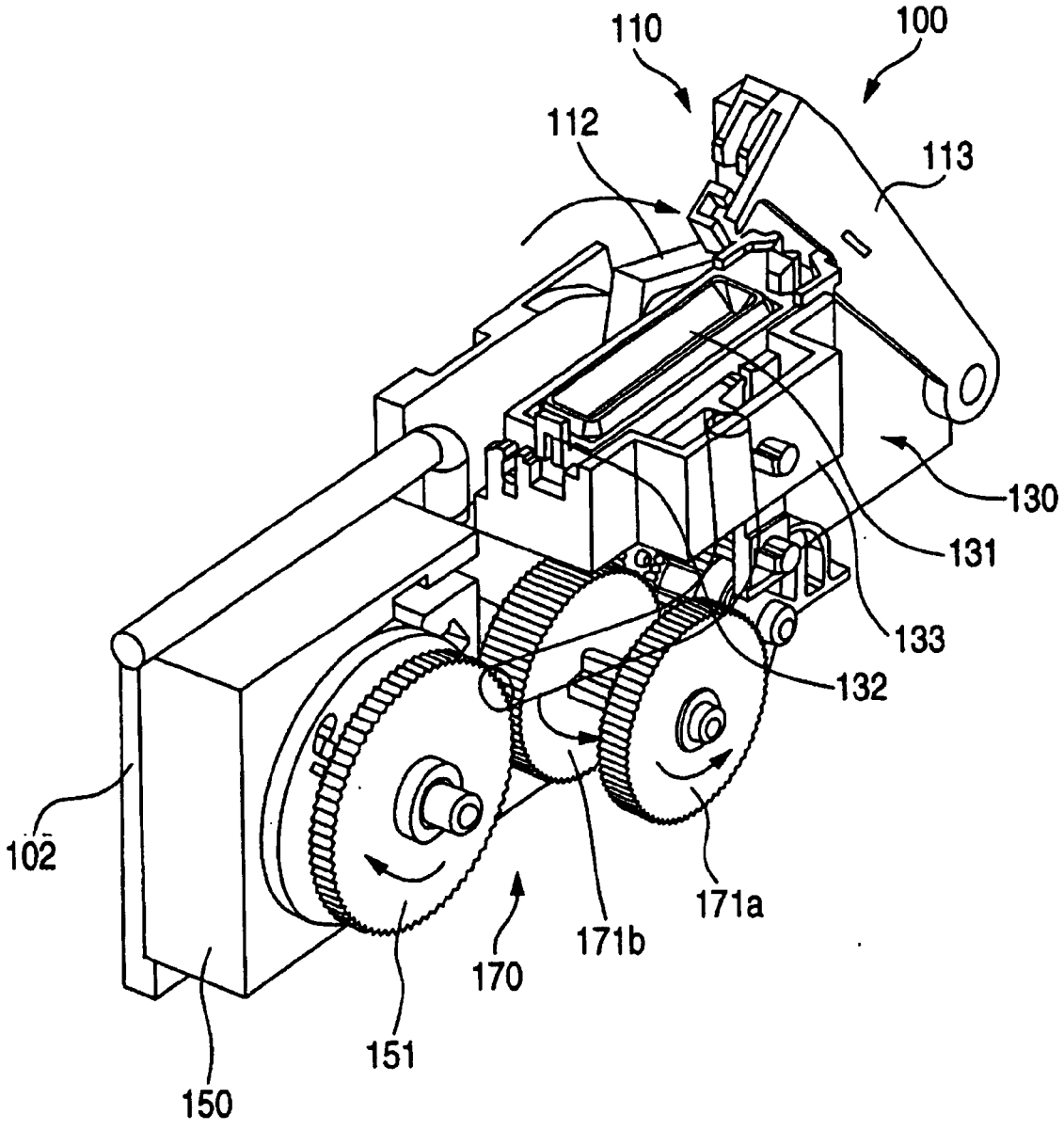
Figure 27:
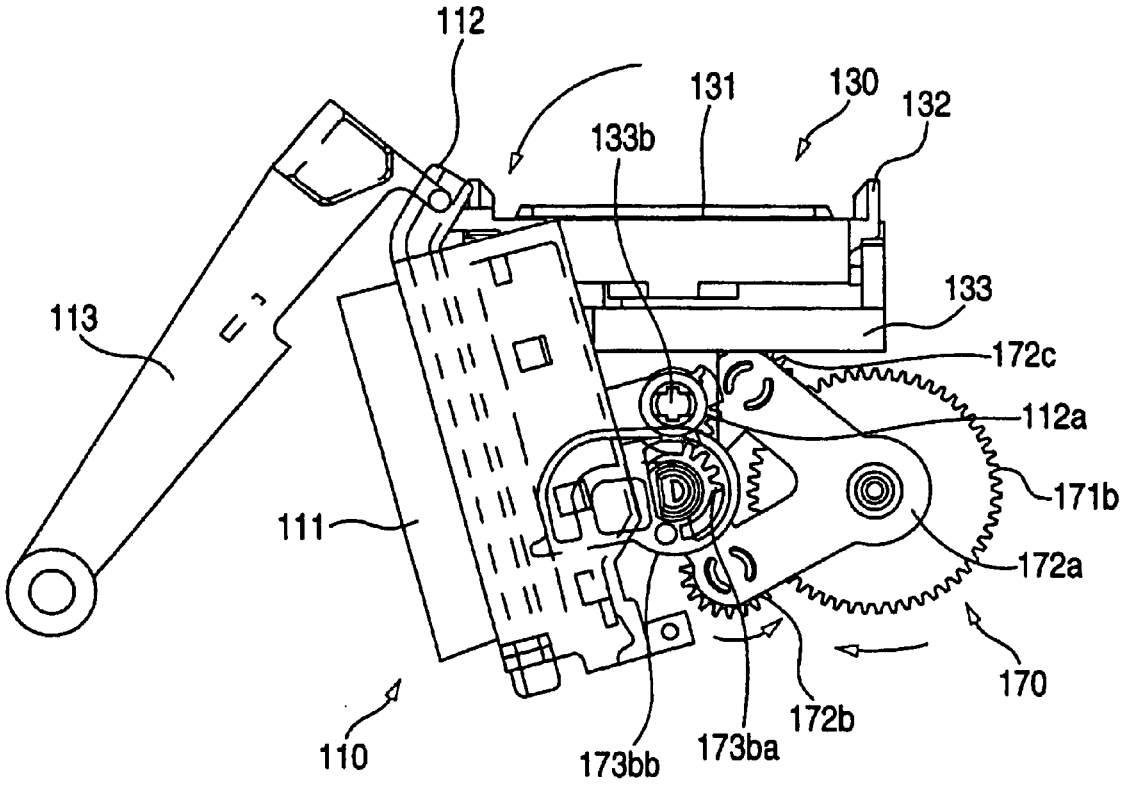
Figure 28:
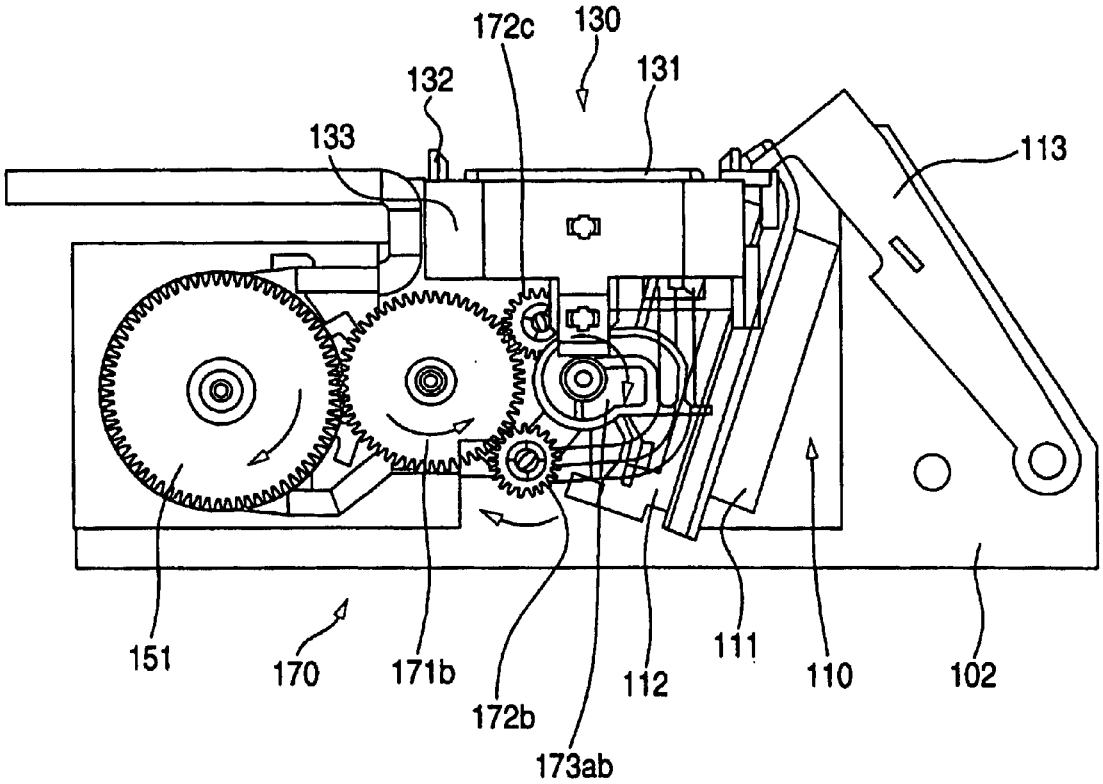
Figure 29:
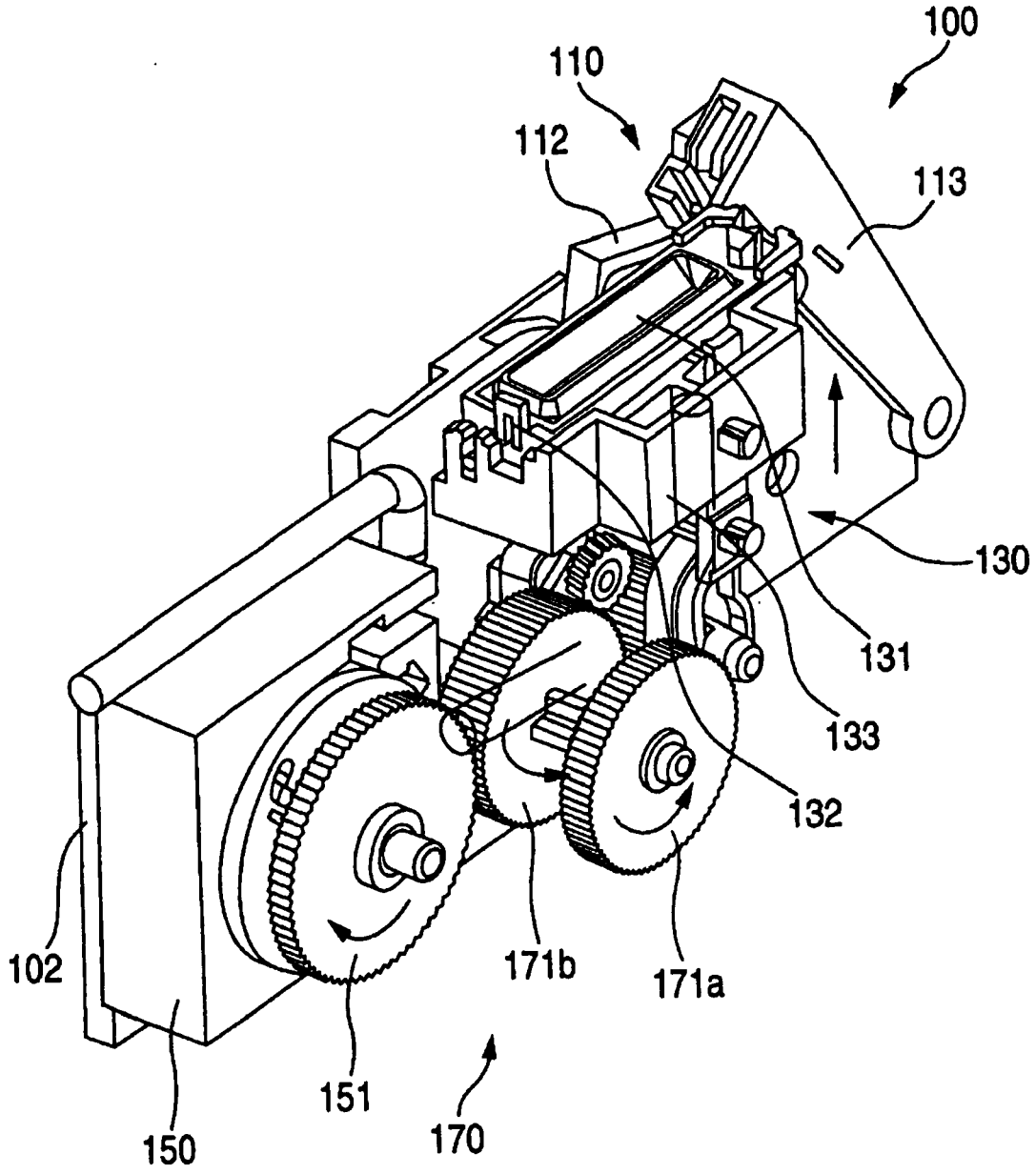
Figure 30:
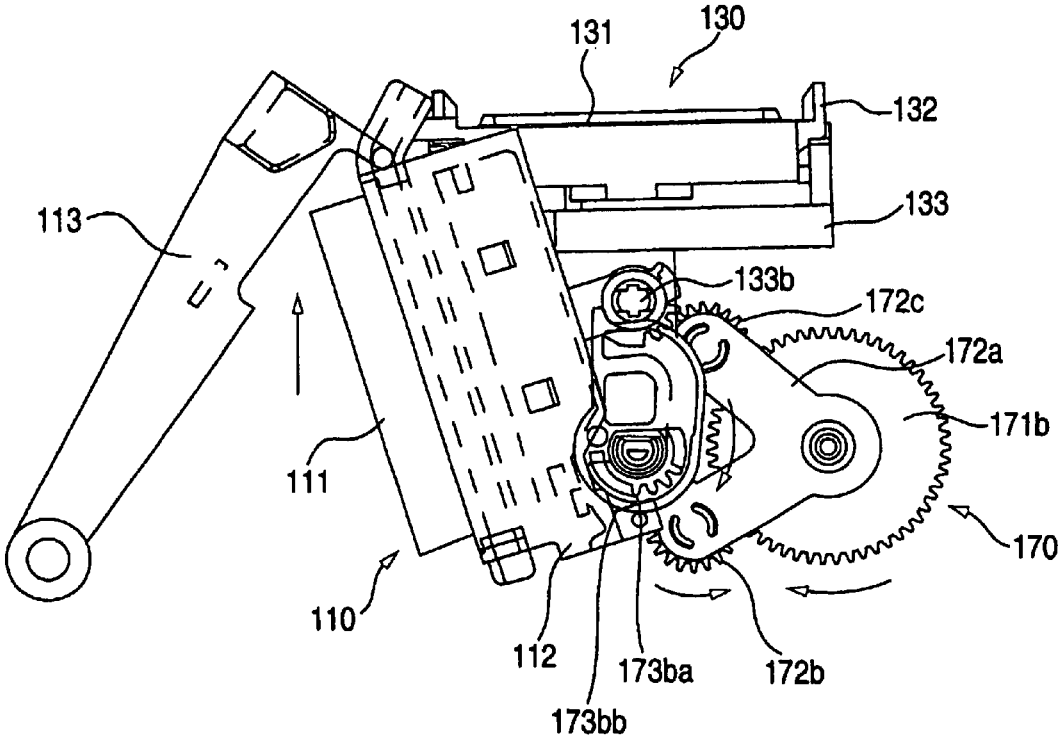
Figure 31:
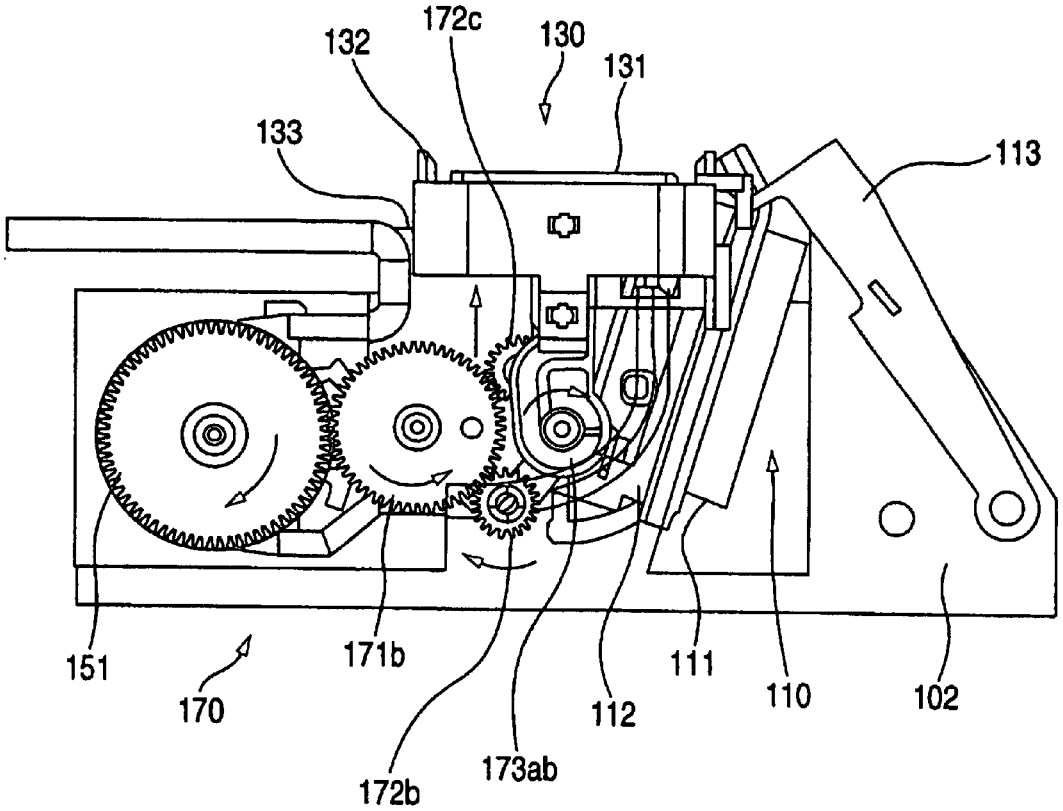

The entire operation of the ink ejectability maintenance device 100 equipped with the wiping unit 110, the capping unit 130, the suction unit 150, and the driving unit 170, which have been described above, will now be described by reference to FIGS. 22 through 31. FIG. 22 is a timing chart showing an example of operation of the ink ejectability maintenance device 100. FIGS. 23 through 25, FIGS. 26 through 28, and FIGS. 29 through 31 show a single operating status from different view points. More specifically, FIGS. 23 through 25 show a state in which the wiper 111 can perform a wiping operation; FIGS. 26 through 28 show a state in which housing of the wiper 111 has been completed; and FIGS. 29 through 31 show a state in which the cap 131 can perform a capping operation.

As shown in FIGS. 23 through 25, when the motor rotates forwardly in the manner as shown in FIG. 22, the capping unit 130 is situated in the lowermost end position. The cap 131 is in an "open" state: that is, an uncapped state. Moreover, the wiping unit 110 is situated in a higher position. The wiper 111 remains in a "set" state: that is, a wipe-enable state. The roller of the pump: that is, the suction unit 150, remains in a "released" state with respect to a tube, i.e., a non-sucking state (point in start time t1).

When in this state the motor is driven in a forward rotation (CW), to thereby rotate the first gear 171*a* and the second gear 171*b*, the switcher arm 172*a* rotates, whereupon the forward rotation gear 173*b* meshes with the partially-chipped gear section 173*aa* of the gear-operated cam 173*a*. The torque of the second gear 171*b* is transmitted from the forward rotation gear 172*b* to the tooth-chipped gear 173*aa* of the gear-operated cam 173*a*, and the gear-operated cams 173*a*, 173*b* rotate. Subsequently, the tooth-chipped gear section 173*ba* of the gear-operated cam 173*b* meshes with the tooth-chipped gear 112*a* of the wiper holder 112, and then the wiper holder 112 starts rotating (point in time t4).

When the tooth-chipped section 173*b* of the gear-operated cam 173*b* becomes disengaged from the tooth-chipped gear 112*a* of the wiper holder 112, the wiper holder 112 stops rotating. As shown in FIGS. 26 through 28, the wiping unit 110 is situated in a lower position, and the wiper 111 remains in a "reset-low" state: that is, a state in which the wiper 111 is housed (point in time t5).

When the gear-operated cams 173*a*, 173*b* rotate, the capping unit 130 starts rising along with the wiping unit 110 by action of the cam section 173*ab* of the gear-operated cam 173*a* and the cam section 173*bb* of the gear-operated cam 173*b* (point in time t6). When the forward rotation gear 172*b* has reached a tooth-chipped section 173*ac* of a tooth-chipped gear section 173*aa* of the gear-operated cam 173*a*, the forward rotation gear 172*b* runs idle. Hence, the capping unit 130 and the wiping unit 110 stop rising.

As shown in FIGS. 29 through 31, in this state, the capping unit 130 is situated in the uppermost end position, and the cap 131 remains in a "closed" state: that is, a capping state. The wiping unit 110 is situated in a position higher than the previous position. The wiper 111 remains in a "reset-high" state: that is a state in which the wiper 111 remains elevated while being housed (point in time t7).

When in this state the motor has rotated forwardly further, to thereby rotate the first gear 171*a* and the second gear 171*b*, the suction unit 150 is activated. At this time, the roller of the pump has bitten at the tube. In other words, the roller of the pump is in an aspirating state (points in time t8, t9). Torque is not transmitted to the pump while the wiping unit 110 and the capping unit 130 are in operation.

When the motor rotates reversely (CCW) in the manner as shown in FIG. 22, the capping unit 130 and the wiping unit 110 operate in a manner reverse to that mentioned above. When the gear 151 shown in FIG. 2 rotates half, the claw of the gear 151 pushes the claw of a disk 152, whereupon the disk 152 starts rotating. In the meantime, the wiping unit 110 and the capping unit 130 have completed operation. Here, the suction unit 150 returns to a "released" state in points of time t3, t4.

As has been described, the ink ejectability maintenance device 100 of the embodiment is provided with the members 112*a*, 112*b*, 113*a*, 173*a*, 173*b*, 112*c*, and 102*b* for effecting positional guiding and fixing operation when the wiping unit 110 is positioned, and the members 133*b*, 101*a*, 102*a*, 173*a*, and 173*b* for effecting positional guiding and fixing operations when the capping unit 130 is positioned.

As a result, the wiping unit 110 and the capping unit 130 can be held in constant positions. Provided that the user has touched the wiping unit 110 or the capping unit 130, they are caused no positional displacement. Consequently, there is obviated an operation for returning the wiping unit 110 and the capping unit 130 to predetermined positions. Further, there is prevented occurrence of damage, which would otherwise be caused when components constituting the wiping unit 110 and the capping unit 130 come into collision with each other, thereby facilitating maintenance.

The wiping unit 110 and the capping unit 130 can be positioned very accurately at all times. Hence, at the time of assembly of the head ejecting maintenance characteristic device 100, there is obviated an operation for causing components constituting the wiping unit 110 and the capping unit 130 to match in phase with each other.

Figure 32:
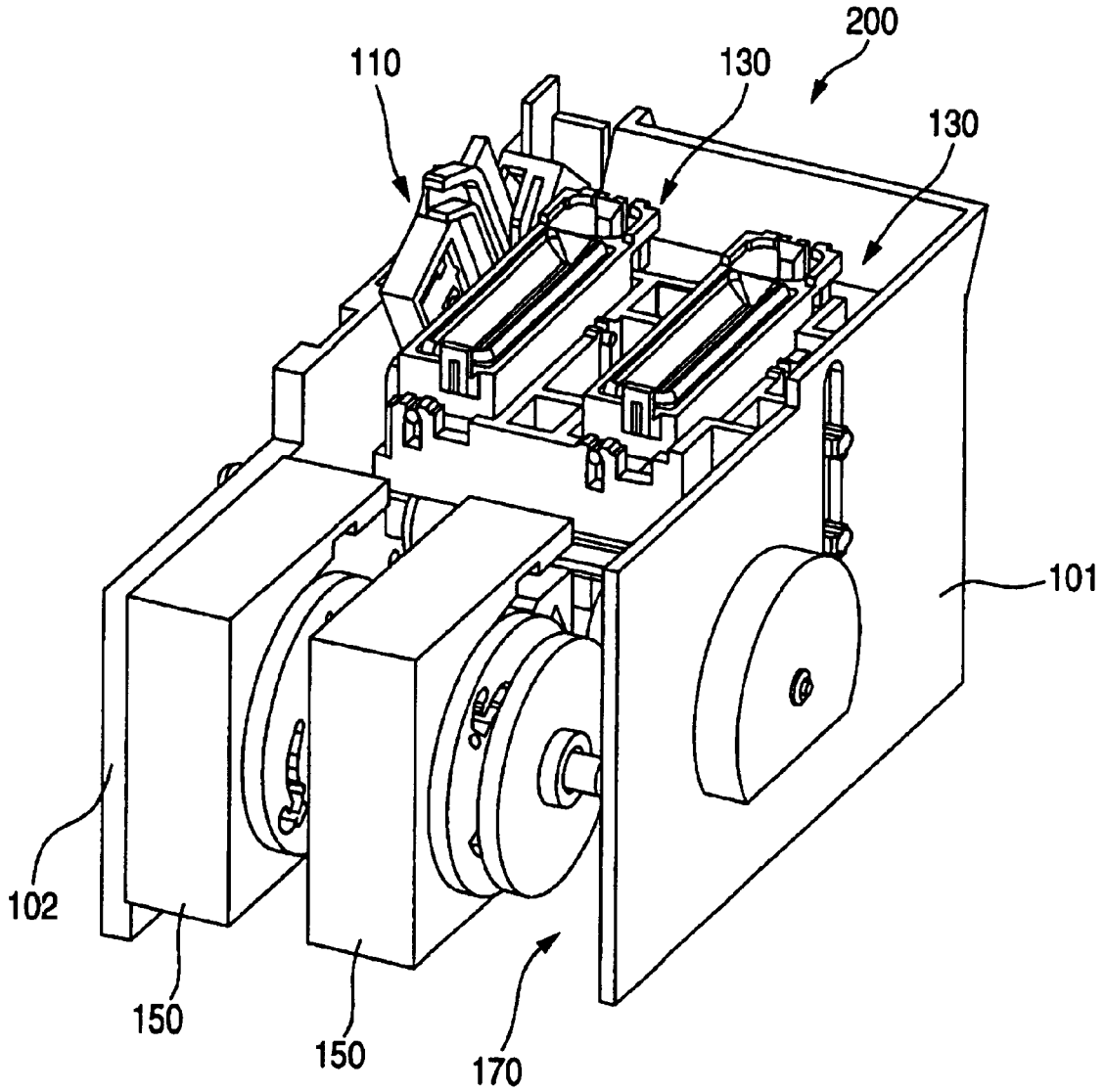
FIG. 32 is a perspective view showing another configuration example of an ink ejectability maintenance device.

The embodiment has described the head ejecting maintenance characteristic device 100 having one capping unit 130 and one suction unit 150. However, the invention is not limited to this embodiment. For instance, as shown in FIG. 32, an ink ejectability maintenance device 200 having two capping unit 130 and two suction unit 150 can be constructed in the same manner and can yield the same effect as that attained by the device 100.

What is claimed is:

1. An ink ejectability maintenance device for maintaining an ink ejectability of a print head which ejects ink droplets to a recording medium, comprising:

a wiper, which wipes a nozzle formation face of the print head; and a wiper cleaner formed with a slit, which removes adhesions on the wiper when the wiper passes through the slit, wherein the wiper and the wiper cleaner change their position in cooperation with each other.

2. The ink ejectability maintenance device as set forth in claim 1, wherein a width of the slit is substantially identical with a thickness of the wiper.

3. A The ink ejectability maintenance device as set forth in claim 1, wherein the wiper is movable between a wiping position and a non-wiping position, and passes through the slit while moving from one of the wiping position and the non-wiping position to the other.

4. The ink ejectability maintenance device as set forth in claim 1, wherein the slit if formed by an ink scraper having a U-shaped cross-section, provided at an upper end of the wiper cleaner.

5. An ink ejectability maintenance device for maintaining an ink ejectability of a print head which ejects ink droplets to a recording medium, comprising:

a wiper, which wipes a nozzle formation face of the print head; and a wiper cleaner formed with a slit, which removes adhesions on the wiper when the wiper passes through the slit, and wherein the wiper cleaner is pivotably held on the device.

6. The ink ejectability maintenance device as set forth in claim 5, wherein the wiper and the wiper cleaner change their position in cooperation with each other.

7. An ink ejectability maintenance device for maintaining an ink ejectability of a print head which ejects ink droplets to a recording medium, comprising:

a wiper, which wipes a nozzle formation face of the print head; and a wiper cleaner formed with a slit, which removes adhesions on the wiper when the wiper passes through the slit, and wherein the wiper cleaner is provided with a guide pin which is fitted with a guide groove formed on a wiper holder which holds the wiper.

8. The ink ejectability maintenance device as set forth in claim 7, wherein the wiper and the wiper cleaner change their position in cooperation with each other.

9. An ink jet printer comprising the ink ejectability maintenance device as set forth in any one of claims 1, 2, 3, 5 or 7.

* * * * *